US009365333B2

(12) United States Patent
Batzel et al.

(10) Patent No.: US 9,365,333 B2
(45) Date of Patent: Jun. 14, 2016

(54) SAFE CONTAINER

(71) Applicant: Zachary (Rocky) Batzel, Moscow, PA (US)

(72) Inventors: Zachary (Rocky) Batzel, Moscow, PA (US); Edward L Batzel, Moscow, PA (US); Daniel A Batzel, Skokie, IL (US); David Anthony Cavalieri, Granger, IN (US)

( * ) Notice: Subject to any disclaimer, the term of this patent is extended or adjusted under 35 U.S.C. 154(b) by 0 days.

(21) Appl. No.: 14/501,239

(22) Filed: Sep. 30, 2014

(65) Prior Publication Data

US 2015/0090686 A1 Apr. 2, 2015

Related U.S. Application Data

(60) Provisional application No. 61/884,360, filed on Sep. 30, 2013, provisional application No. 61/927,185, filed on Jan. 14, 2014, provisional application No. 61/991,487, filed on May 10, 2014, provisional application No. 62/022,758, filed on Jul. 10, 2014.

(51) Int. Cl.
*B65D 50/04* (2006.01)
*B65D 43/20* (2006.01)

(52) U.S. Cl.
CPC ..... *B65D 50/04* (2013.01); *B65D 43/20* (2013.01); *B65D 2215/02* (2013.01); *B65D 2543/0049* (2013.01); *B65D 2543/00194* (2013.01); *B65D 2543/00296* (2013.01); *B65D 2543/00546* (2013.01)

(58) Field of Classification Search
CPC .... B65D 50/046; B65D 50/045; B65D 50/04; B65D 43/20
USPC ..... 220/812, 811, 810, 284, 260; 215/305, 215/302, 295, 216, 215, 201
See application file for complete search history.

(56) References Cited

U.S. PATENT DOCUMENTS

| | | | |
|---|---|---|---|
| 2,273,998 | A | 2/1942 | Rueger |
| 2,492,846 | A | 12/1949 | Coyle et al. |
| 3,240,373 | A | 3/1966 | Dulle |
| 3,720,346 | A | 3/1973 | Cypher |
| 3,924,768 | A | 12/1975 | Lemons |
| 3,949,899 | A | 4/1976 | Jacobs et al. |
| 4,832,221 | A | 5/1989 | Manem |
| 5,058,775 | A | 10/1991 | Gross et al. |

(Continued)

OTHER PUBLICATIONS

International Application No. PCT/US14/58219, International Filing Date: Sep. 30, 2014, International Search Report, Written Opinion of the International Searching Authority, Date of Mailing of the International Search Report Jan. 2, 2015.

*Primary Examiner* — Robert J Hicks
(74) *Attorney, Agent, or Firm* — Burns & Levinson LLP; Jerry Cohen

(57) ABSTRACT

Novel lockable safe containers for dispensing valuable, dangerous and potentially dangerous goods via a main opening that is easy for adults to open and difficult for children to open, using a finger pressure on a sliding closure with a deflectable extension operable by finger pressure to enable. The novel safe containers have many additional advantages including human factors, ergonomics, manufacturing, supply chain and distribution, warehousing, retail, tamper resistance advantages, and labeling. The slidable closure exits the main opening zone via an auxiliary opening but wholly without exiting the container in normal usage.

26 Claims, 23 Drawing Sheets

(56) References Cited

U.S. PATENT DOCUMENTS

| | | | |
|---|---|---|---|
| 5,082,137 | A | 1/1992 | Weinstein |
| 5,400,914 | A | 3/1995 | Lin |
| 6,510,960 | B1 | 1/2003 | Christopherson et al. |
| 7,114,619 | B2 | 10/2006 | Ellis et al. |
| 7,178,674 | B2 | 2/2007 | Krumme |
| 7,275,653 | B2 | 10/2007 | Tedford, Jr. |
| 7,481,339 | B1 | 1/2009 | Hsu |
| 7,594,588 | B2 | 9/2009 | Auer |
| 8,657,136 | B2 | 2/2014 | Adler |
| 2005/0218031 | A1 | 10/2005 | Murphy |
| 2010/0276461 | A1 | 11/2010 | Stevens |
| 2013/0320017 | A1 | 12/2013 | Kientzle et al. |

SAFE CONTAINER

CROSS REFERENCE TO RELATED APPLICATIONS

This application has priority from U.S. provisional applications (61/884,360 filed Sep. 30, 2013, 61/927,185 filed Jan. 14, 2014, 61/991,487 filed May 10, 2014 and 62/022,758 filed Jul. 10, 2014), the full texts and other contents of which are incorporated herein by reference as though stated and shown at length herein.

FIELD AND BACKGROUND OF THE INVENTION

This invention pertains to a container, particularly useful for but not limited to over the counter (OTC) or prescription drugs. Currently most medicines are distributed in a cylindrical container which uses a push and turn mechanism to unlock the bottle. With the amount of children who fatality ingest medicines, the child resistant feature is a mandatory component for all OTC and prescription drugs. However, this push and turn mechanism gives individuals with limited dexterity (specifically the elderly) difficulty opening the container to obtain their medicines. In addition, there are many other negative attributes to the standard packaging system that the present invention satisfies. State of the art is exemplified by the disclosures of U.S. Pat. Nos. 2,273,998; 2,492,846; 3,240,373; 3,924,768; 3,949,899; 4,832,221; 5,400,914; 5,058,775; 5,082,137; 7,114,619; 7,178,674; 7,275,653; 7,594,588 and 8,657,136. Also, U.S. patent application publication number US2013/0320017, published Dec. 5, 2013.

SUMMARY OF THE INVENTION

The invention is preferably implemented in polyhedral container forms (square, rectangular, pentagonal, etc. in cross section), generally referred to as "cuboidal" herein or, as applicable, "truncated cuboidal" but can be implemented in other container forms, e.g. classic cylinder or ellipsoid or even spherical containers, with a cap that has a zone of polyhedral or truncated polyhedral form or even a flat top with a simulation of the cuboidal form with a main opening for access to contents and an auxiliary opening. The invention includes provision for a sliding closure (slider) within one or more tracks or grooves and retaining means to retain the slider in the container opening, generally rectangular (but other forms are permissible). The slider and accommodating cap structure effect opening and closure via the auxiliary opening. Slider movement is made under finger or thumb pressure and latching at a far end of the slider motion range. One or more depressible tabs, preferably cantilevered, may be used for transmitting finger pressure to the slider to manage its sliding and when the slider is retracted, the tab springs up providing an audible or visual indicator of closure. Retaining buttons and/or locks can also be employed as described below in connection with some embodiments.

Other objects, features and advantages will be apparent from the following detailed description of preferred embodiments taken in conjunction with the accompanying drawings in which:

BRIEF DESCRIPTION OF THE DRAWINGS

FIG. 17D shows a coupled triplet fixed by interlocking rails.

DETAILED DESCRIPTION OF PREFERRED EMBODIMENTS

Figure 1A:
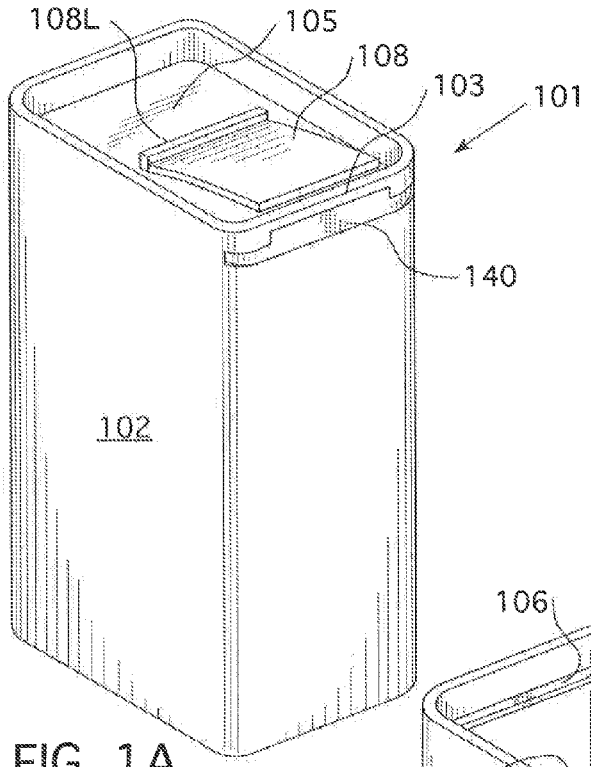
FIGS. 1A and 1B show, in isometric views, an embodiment of safe container in a closed/locked state (1A) and an open/unlocked state (1B)
Figure 1B:
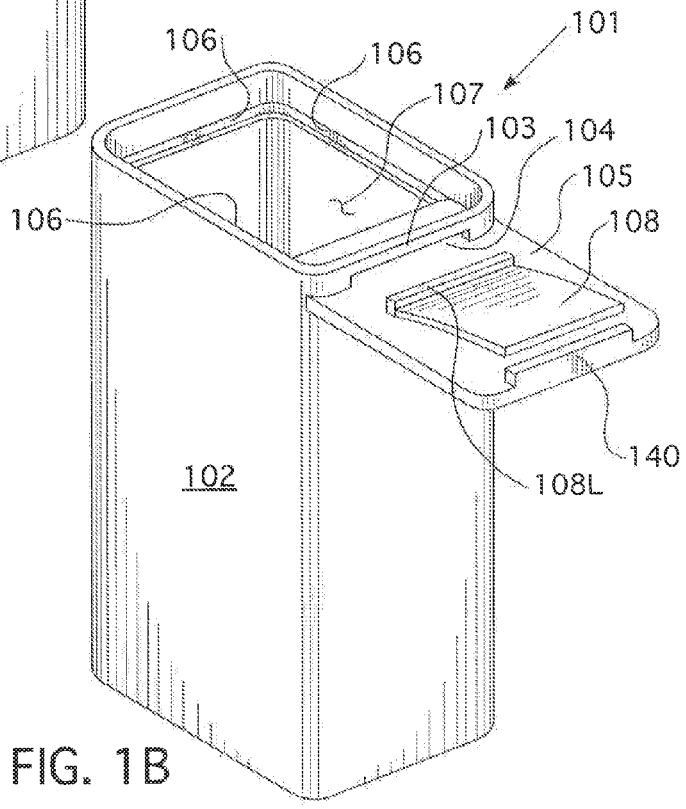
Figure 2A:
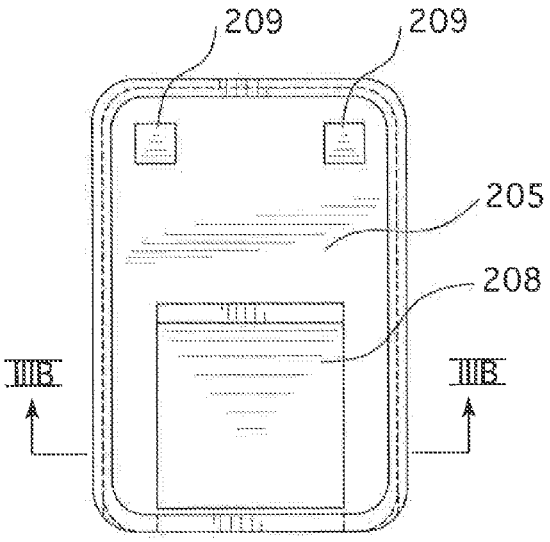
FIGS. 2A-2D show in 'top views' (2A and 2B) and isometric views (2C and 2D) an embodiment of safe container having a feature facilitating one handed operation in a closed/locked state (2A and 2C) and an open/unlocked state (2B and 2D)
Figure 2B:
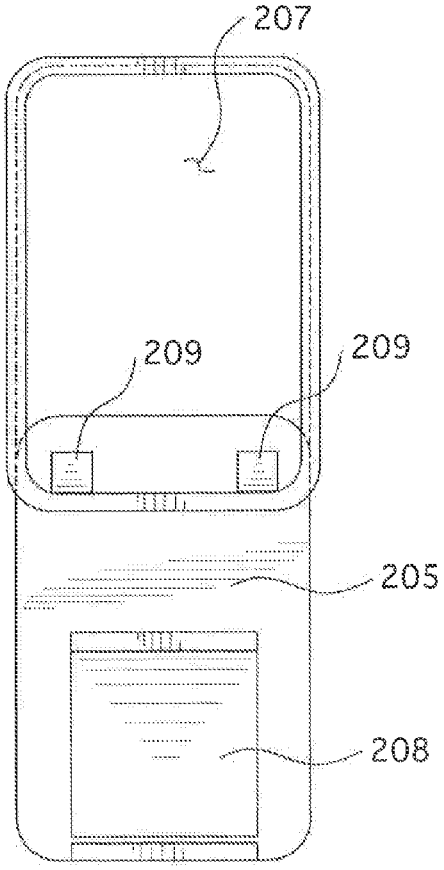
Figure 2C:
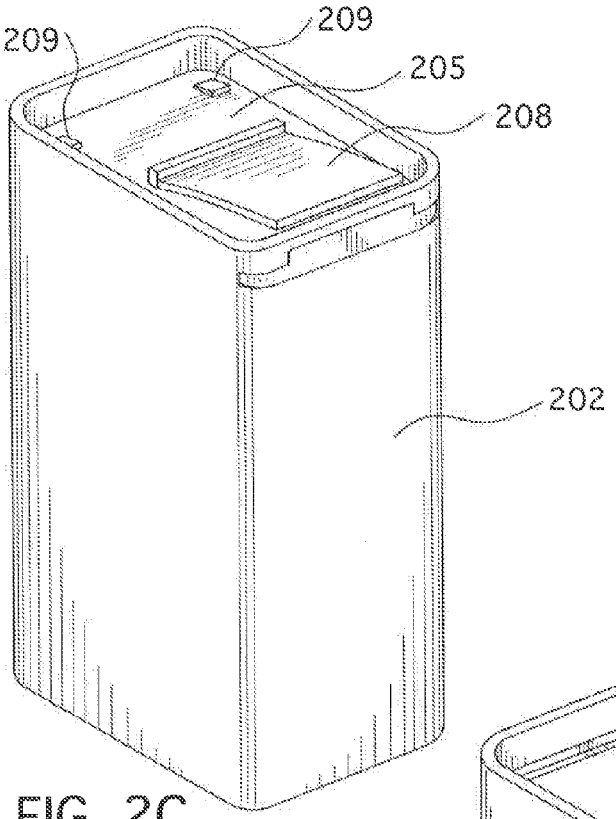
Figure 2D:
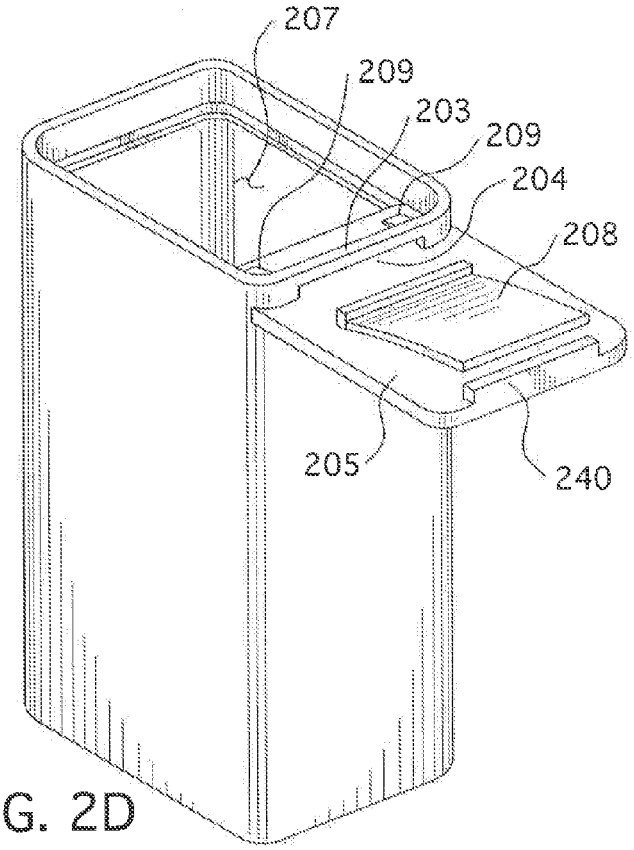

Referring to FIGS. 1A and 1B, the medicine container 101 comprises a single or multi-compartment container 102 that can hold medicine joined to a closure mechanism comprising tab/button blocking bar 103, auxiliary opening 104, slider 105, slider-groove 106, a main opening 107, and one or more independent depressible tabs 108 connected to slider. Also shown in FIGS. 1A and 1B is optional back lip 108L connected to both slider and depressible tab. Each depressible tab is normally taller than auxiliary opening clearance. Access to the container contents is accomplished by depressing each depressible tab to a height that clears auxiliary opening and moving the slider through the auxiliary opening a distance sufficient to allow medicine or other content to be removed through main opening. While the slider is shown flat in FIGS. 1A and 1B, it can also be of curved (arcuate) form where the other components of the closure, mechanism may be adapted, if necessary or desired, to accommodate the curvature.

The depressible tab and slider shown in FIGS. 1A and 1B may be fabricated as separate elements that are subsequently connected (e.g. joined, fitted or mated) in an assembly process by appropriate means including adhesive, thermal, ultrasonic, mechanical, hardware fastening, optical and chemical welding or joining means for example or, preferably, the depressible tab and slider may be fabricated as a unitary piece by molding or 3D printing processes for example and optionally subjected to a subsequent finishing process such as sculpting, polishing or deburring for example.

The back lip 108L shown in FIGS. 1A and 1B is an optional structure that is slightly elevated above the slider for facilitating manipulative pushing or retracting slider and it should not be construed that the back lip is a necessary component of the connection between the depressible tab and slider, however, when it is desired to incorporate a back lip to facilitate manipulation it can be made to be a component if so desired, especially for convenience in manufacturing or for the purpose of buttressing or strengthening the connection. While details on the opening and closing of the medicine container are given below in later sections, in a study with adult participants using a prototype like that shown in FIG. 1A we have found some participants with long fingernails prefer retracting the slider in part by catching their nail on the back lip 108L.

The medicine container may contain human or animal medicines including packaged medicines. The medicines may include (i) solids, including discrete or monolithic solids, semisolids and certain gels; and (ii) Newtonian or Non-Newtonian fluids. Examples of (i) and (ii) include pills, whole tablets, segmentable tablets, capsules, "gummy bear"-like formulations, cough syrups, antibiotic suspensions, segmentable medicated "candy bars", medicated gums, wafers and leafs, sheets of perforated blister container tablets, medicated powders, medicated or un-medicated shampoos, lotions, tobacco products, nicotine products gelatins, yogurts, solutions contained in sealed aluminized plastic casings and radioactive medicines (provided, as a precautionary statement, that the containers are comprised of appropriate radiation shielding materials), Non-medicinal foods or cosmetic articles may also be contained in the container—e.g. buttons, needles, string, rubber, and chemical additives.

In some cases it may be either desirable or required that an implement such as, for example, a syringe, spoon, syringe needle, straw, forceps and finger be inserted through the main opening in order to remove the contents. Of course the unused portion of any segmentable and perforated medicines removed would normally be returned. If required or desired the medicine container may be adapted where the main opening is a piercable septum to accommodate syringe needles or may be adapted where the main opening is a syringe fitting, such as a Luer connector, for example, to accommodate a syringe. In some cases it may be either desirable or required for the contents to be removed using gravity assist, such as for example by tipping the container and pouring or sprinkling the contents and in such cases the container may be adapted to incorporate a spout or screen, for example, to facilitate this pouring or sprinkling respectively. It is conceivable that some contents may be removed by sipping or suction by mouth and in such cases the medicine container may be adapted with a mouthpiece or adapted with the fittings to accommodate an attachable mouthpiece accessory to facilitate this. A variety of accessories for the medicine container of this invention can be contemplated. One particularly advantageous and convenient accessory is a medicine catching attachment such as a spoon or net for example that can be mounted to the medicine container. Such a mounting may involve strategically positioned cooperating rails for example, and further, that the mounting may provide means for the medicine catching attachment and the medicine container to pivot in relation to each other. Because the medicine containers of this invention lend themselves very well to one-handed opening and closing, by incorporation of a medicine catching attachment, certain medicines can be dispensed from the container into the medicine catching attachment without need of a second hand to catch the medicine and this provides a significant relief to persons without the use of two able hands to take their medicine.

The container of the invention may be used, or easily adapted to contain dangerous or potentially dangerous chemicals and household products and goods such as, for example, rat poison, rubbing alcohol, drain cleaner, certain cosmetics, insect repellents, vitamins, Tobacco, nicotine products, legal marijuana and nutraceuticals. The container of the invention may contain foods, such as baby foods, for example, and this is especially advantageous when optional tamper resistance elements, described below, are employed. The container of this invention could be used as a vessel to transport dangerous or potentially goods such as biological warfare agents and blood specimens for example.

Note that in many cases it is desirable that the slider be retained so that it doesn't move out too far through the auxiliary opening. One way to do this is to employ a retaining button or bar on the slider. As an option, means to retain slider and connected depressible tabs so that they don't become detached (uncoupled from the slider-groove), either during ordinary usage or permanently, from the rest of the medicine container may be incorporated. There are many ways to accomplish this and most involve an interaction between a component on the top or bottom surfaces of the slider and another component on the rest of the container.

In FIGS. 2A, 2B, 2C, and 2D where parts similar to those of the product shown in FIGS. 1A, 1B, appear parallel, i.e. sliding closure 105 in FIGS. 1A-1B, 205 in FIGS. 2A-2D and 140 for a sliding closure lip in FIGS. 1A-1D and 240 in FIG. 2D, FIGS. 2A-2D show one exemplary means of retaining the slider and connected depressible tab(s) 208 during ordinary usage by incorporation of at least one retaining-button 209 which is sufficiently taller than auxiliary opening 204 clearance or offset from blocking bar 203 ensuring slider and connected depressible tabs remain attached during ordinary usage, yet only just slightly taller thus enabling one to detach the slider and connected depressible tabs by application of a modest force sufficient to cause passage via elastic deformation of the retaining-button(s) 209 and in this case it is preferred that at least a portion of each retaining-button is polymeric and it should be understood that the slider and connected depressible tabs can be reattached to the rest of the medicine container, or first time attached, such as after initial filling the container with medicine, for example, by applying a modest force to the retaining-button(s) for entry via the auxiliary opening. The retaining-button may be permanently attached to the slider by means of a permanent adhesive for example, or made part of the slider, by molding or 3D printing for example, or semi-permanently attached by means of a pressure sensitive adhesive for example.

The retaining-button can even further facilitate one handed opening and closing operations and this is a considerable advantage over the screw capped pharmacy bottles in widespread use today because the consumer doesn't have to handle separate pieces like a cap and a bottle, let alone also juggle medicine. Still, one can contemplate certain medicines and situations where consumers may have a preference to detach the slider and connected depressible tab from the rest of the medicine container and this is made possible in the embodiment described above with little burden. Another embodiment would be a consumer depressible retaining-button.

On the other hand, situations are envisioned where a manufacturer or pharmacy may desire to make it permanent that slider and connected depressible tab(s) 208 cannot be detached from the rest of the medicine container. One situation is in a medicine container reuse program where washing protocols may vary according the medicines formerly contained in the container and in this situation it is usually desirable that all components remain together. This can be accomplished in the following manner. First, the manufacturer or pharmacy fills the container; next, inserts slider and connected depressible tabs; and then permanently attaches one or more retaining-buttons to the slider, using, for example, a cyanoacrylate adhesive where in this situation the retaining-button(s) is too tall or the various contacting components made too rigid to permit passage through auxiliary opening under forces ordinarily applied by consumers, lest something should break. It should now be recognized that when it is desirable to incorporate a back lip 108L like that shown in FIG. 1A then it, if additionally desired, it may be elevated sufficiently above the slider where it acts as a retaining-button.

Additionally, the end of the slider may optionally elevate upward slightly to the height of the auxiliary opening. This option is the auxiliary opening cover 140. The auxiliary opening cover camouflages the auxiliary opening when slider is in the closed/locked position making it difficult to see/determine the direction or approach to open the medicine container. This adds to the intellectual challenge of opening the medicine container and increases child resistance.

It should now be readily apparent that areal access to container contents varies according to the position of the slider and placements of retaining-button(s) of the above embodiments more proximal to blocking bar 203 provide less areal access than less proximal placements. Therefore, by the strategic placement of retaining-buttons on various embodiments of this invention on slider and by strategic size and shape selection of certain medicines a certain degree of portion control can be obtained in certain cases.

Figure 3A:
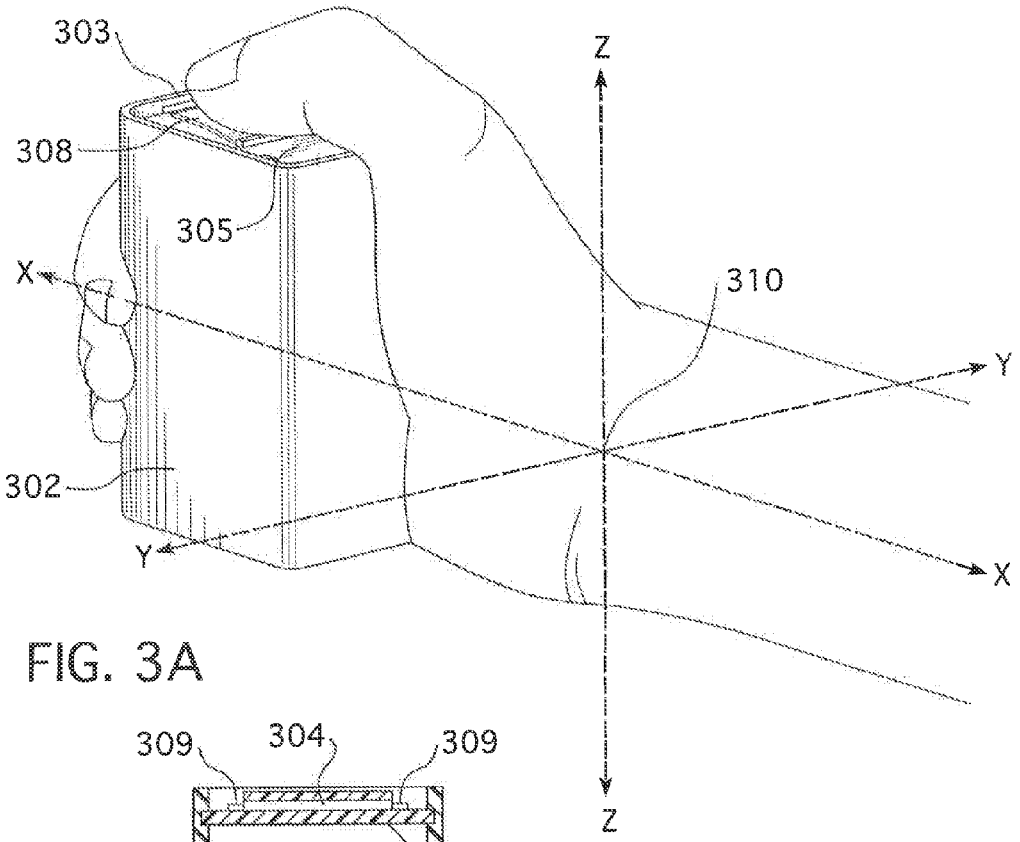
FIGS. 3A (isometric view) and 3B (being a cross section of the FIG. 3A container/tab combination) show one means of grasping a safe container embodiment.
Figure 3B:
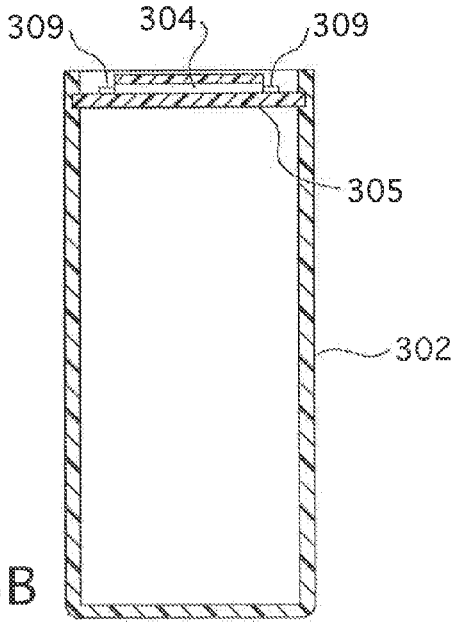
FIGS. 11A-11C show the main opening portion of various multicompartment cuboidal safe container embodiments with two independent compartments formed by a wall parallel to its long axis (FIGS. 11A and 11B) or with four compartments (11C) and FIG. 11D shows an isometric view of another two compartment container embodiment with stacked compartments and two one-way sliders and FIG. 11E-1 through FIG. 11E-3 show a four compartment container embodiment with two over two compartments and two two-way sliders in "top view" closed/locked state (FIG. 11E-1), in 'top view' one-way open state (FIG. 11E-2) and in opposite 'bottom view' one-way open state (FIG. 11E-3).

FIG. 3A shows a consumer gripping an embodiment of the medicine container 302 (which has depressible buttons, 309 similar to button 209 of FIGS. 2A-2D while pressing depressible tab 308 with thumb flexed at the interphalangeal joint to a height below blocking bar 303 and before moving slider 305 and also shows Cartesian x, y, z axes having an origin 310 in the wrist. To open the medicine container depicted here an adult consumer would make an anatomically distal motion of the thumb to move the slider through auxiliary opening 304 which is depicted in FIG. 3B. Closing the container is a simple matter of reversing the path of the slider and in a study conducted with adult participants using a prototype like that shown in FIG. 2, numerous methods of doing this were observed. Participants successfully used the medicine container (as shown in Table 1) and were reassured that the medicine container was closed by the audible clicking sound heard when the slider was fully reversed and cleared the auxiliary opening to spring up with a characteristic click and the visible and tactile observation of the cantilevered depressible tab reverting to its normal uncompressed form after clearing the opening or retraction of the slider. Other forms of audible, tactile and or visual assurance can be provided.

TABLE 1

| Subject | Age | Sex | Open container successfully? |
|---|---|---|---|
| 1 | 63 | Male | YES |
| 2 | 63 | Female | YES |
| 3 | 88 | Female | YES |
| 4 | 74 | Female | YES |
| 5 | 72 | Male | YES |
| 6 | 59 | Male | YES |
| 7 | 77 | Female | YES |

The medicine containers disclosed here have clear ergonomic advantages over popular screw cap pharmacy bottles and others which require a twisting motion, among other motions when they possess child resistant features. The grip depicted in FIG. 3 and operation explained above are comfortable and have low potential, if any, for adverse strain, both acute and chronic, when operated by adult consumers of average stature and health. One reason for this is because, referring to FIG. 3, the fingers are only slightly flexed (note: a thumb is a digit but not a finger) and another reason is because, aside from the motion that the thumb makes, which is small, few other, if any, motions are necessary, and if they are their magnitudes are small (a) within the x,z-plane, i.e. radial deviation-like through ulnar deviation-like motions; (b) within the x,y plane, i.e. flexion-like through extension-like motions; and (c) rotation around the x-axis, i.e. pronation-like through supination-like motions.

Figure 11A:
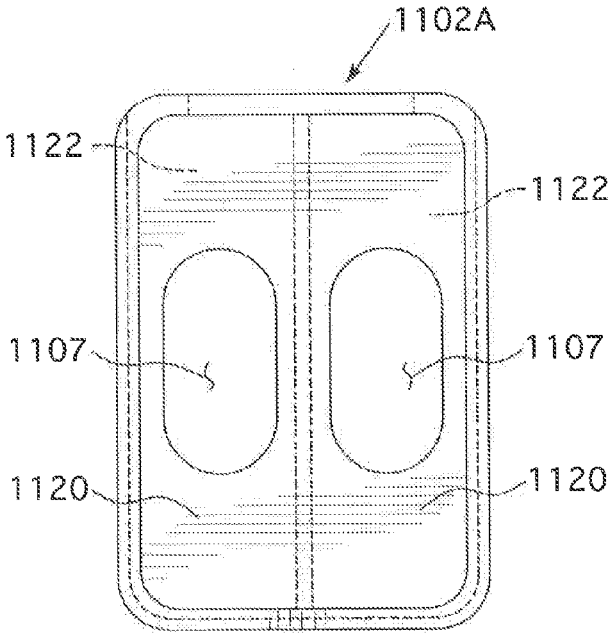
Figure 11B:
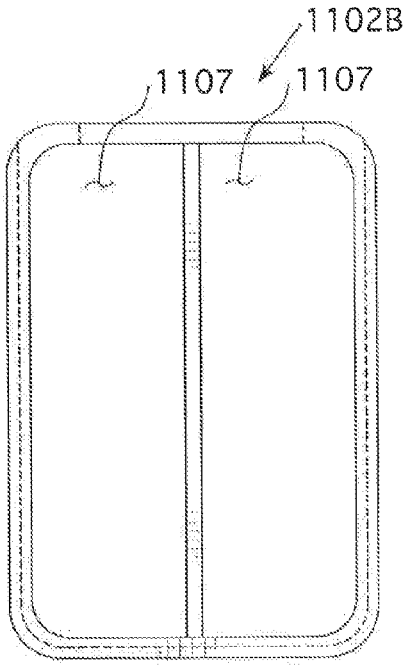
Figure 11C:
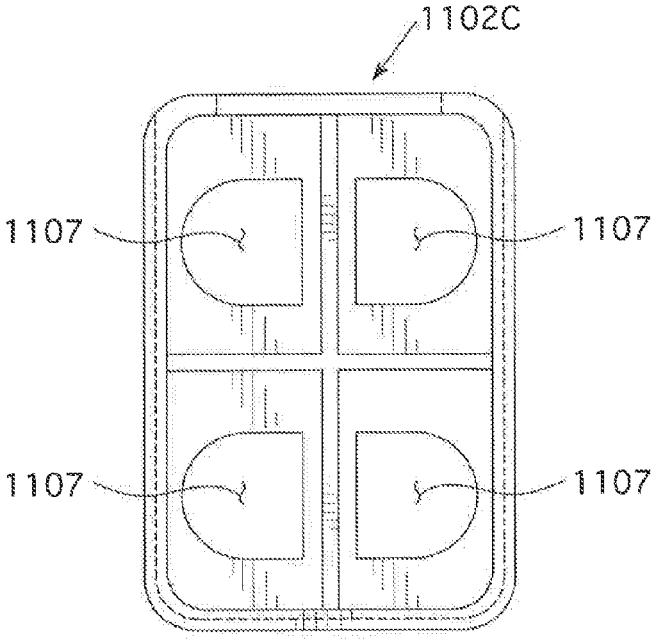
Figure 11D:
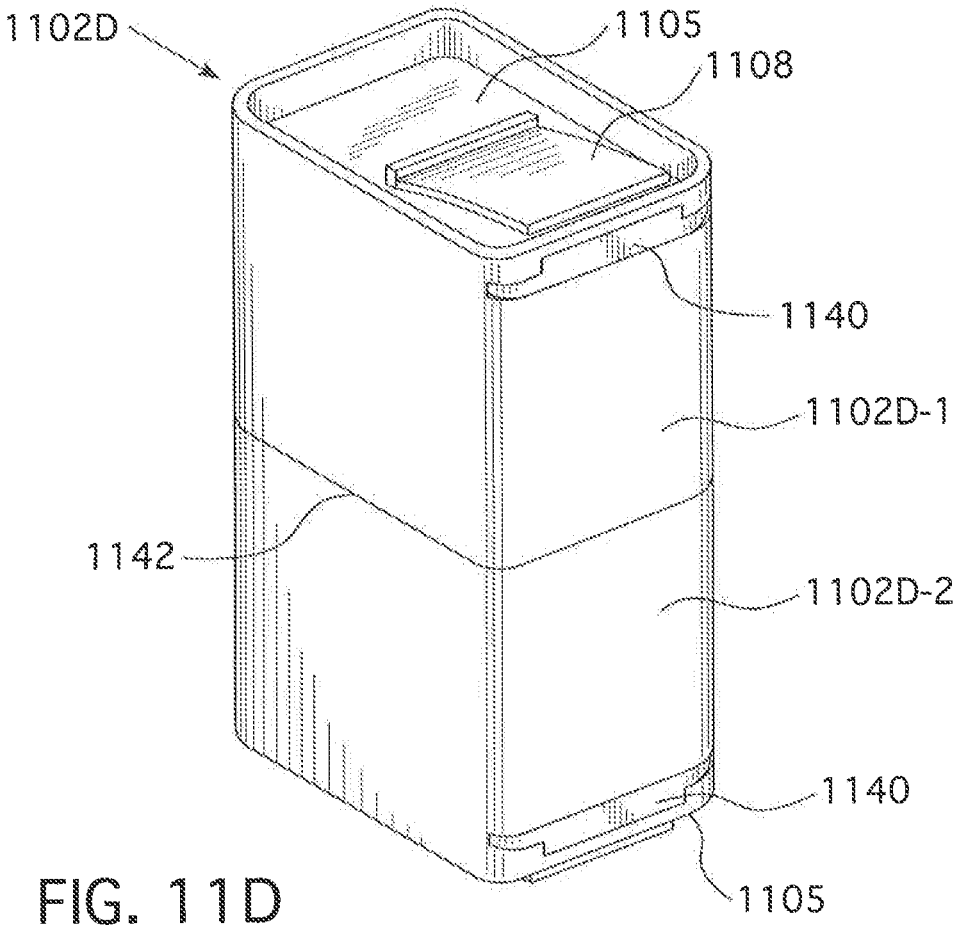
Figures 1, 11E:
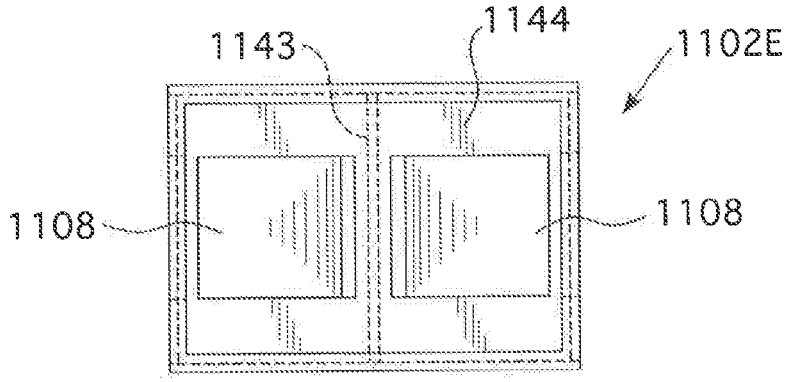
Figures 2, 11E:
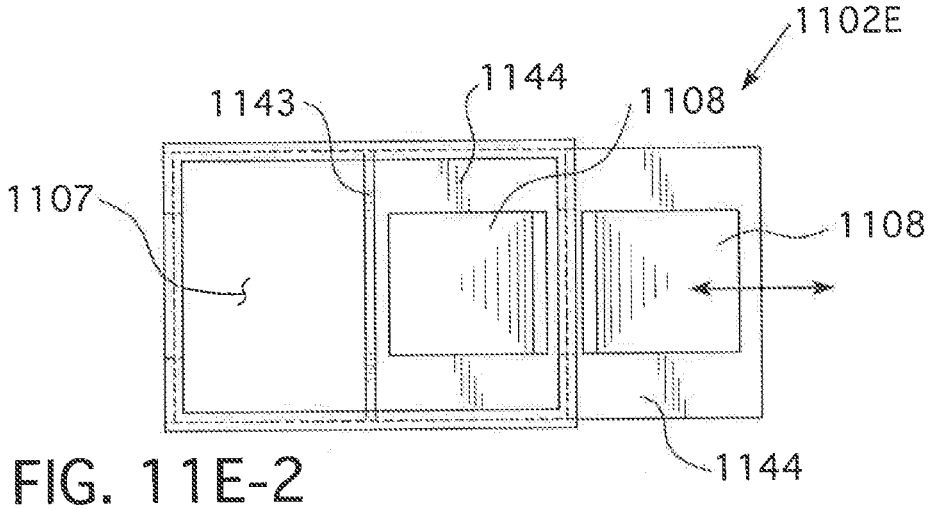
Figures 3, 11E:
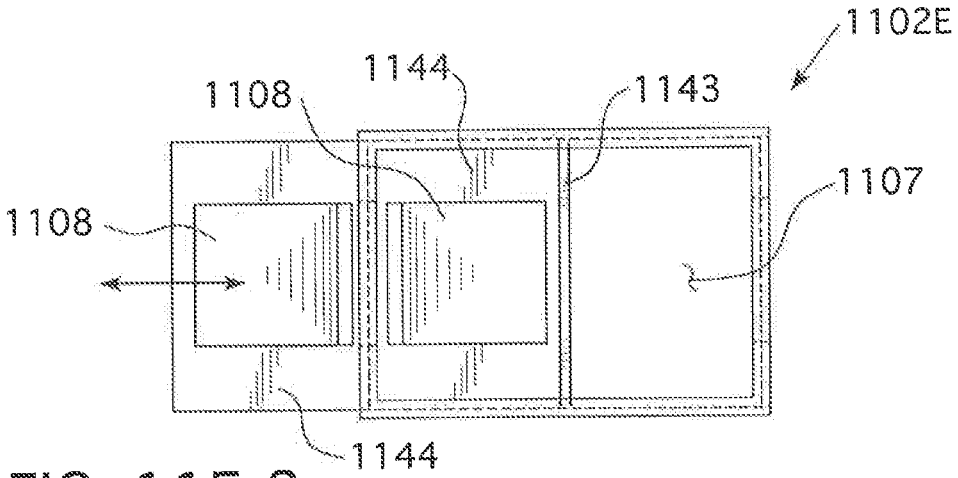

As observed in a study with adult participants using a prototype like that shown in FIG. 2, and probably attributable to the fact that adults vary in stature and health status, the medicine container may be grasped and manipulated differently than the way depicted in FIG. 3 and furthermore, other means beside the thumb may be employed, for example other digits and implements, to press depressible tab and move slider. A two handed operation may be employed, in particular when the medicine container is sized to hold large volumes of medicine.

Figure 4A:
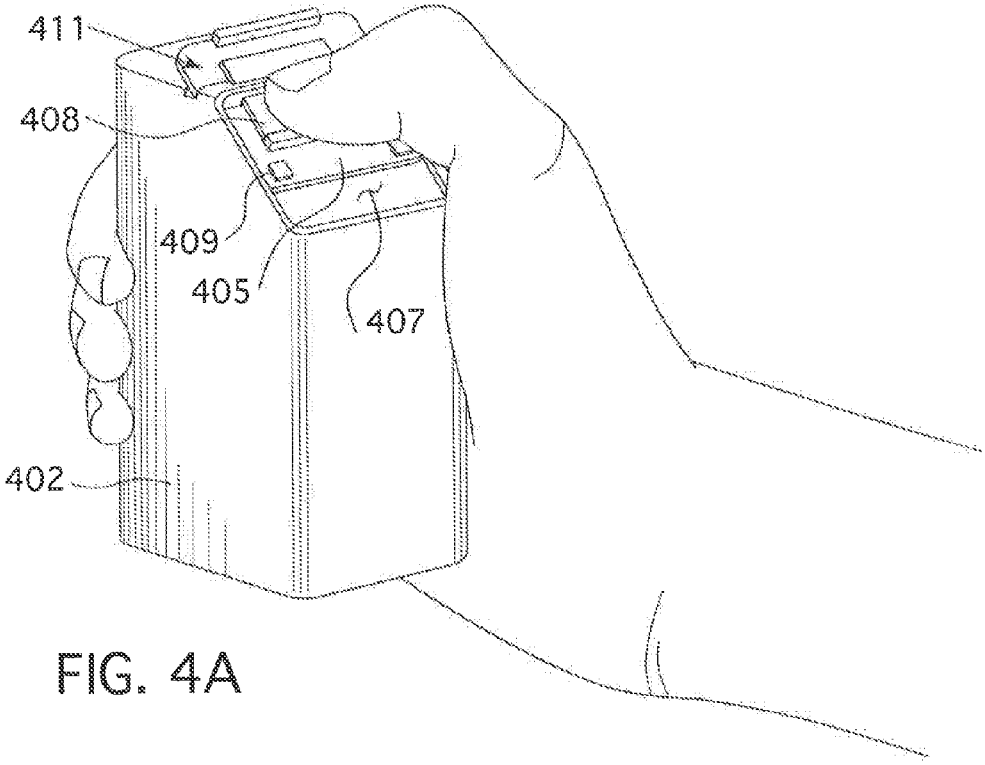
FIGS. 4A and 4B (isometric views) show two embodiments of safe container, one without digit grips (4A) being manipulated and one with digit grips (4B)
Figure 4B:
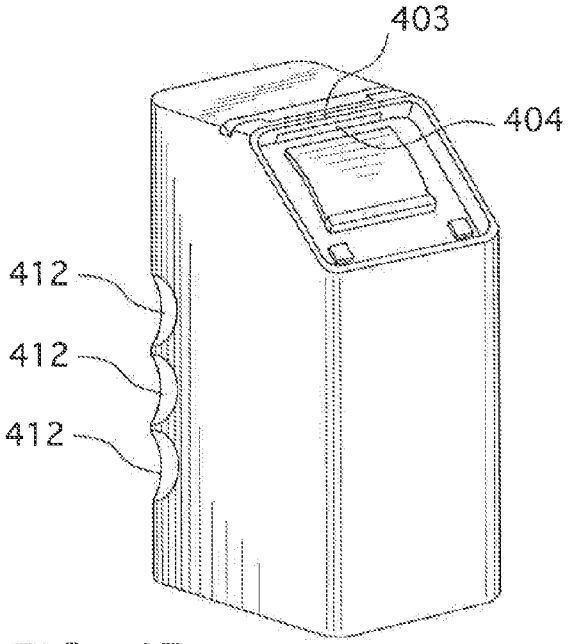

Adult consumers with shorter than average thumb lengths or certain conditions that limit the motion of the thumb may prefer a truncated cuboidal shape shown in profile in FIG. 4A—a container 402 where the closure mechanism (i.e., blocking bar 404, auxiliary opening 403, slider 405, slider-groove, main opening 407 and depressible tab(s) 408 and buttons 409 connected to slider) are located on an inclined container face 411 that provides for an overall more ergonomically accommodative geometry. Also, for example, one or more shaped structures, indented, bulged, or otherwise, such as palmar grips, palmar loops, handles, digit grips (FIG. 4B, 412) and digit loops for example may optionally be molded or otherwise incorporated into or with the medicine container for the purpose of providing additional leverage for pressing depressible tab or moving slider or for additional ease of handling.

Figure 5A:
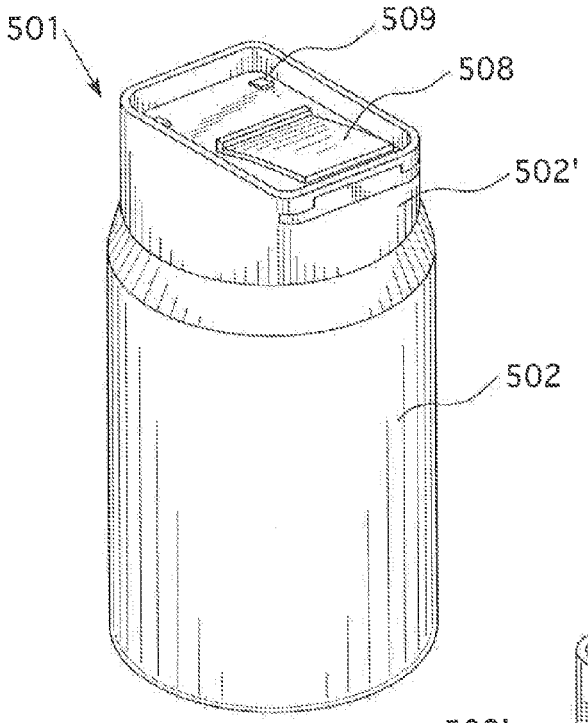
FIGS. 5A and 5B (isometric views) show another embodiment of safe container having a cylinder shape for a lower portion and cuboidal for an upper portion and a transition between such portions.
Figure 5B:
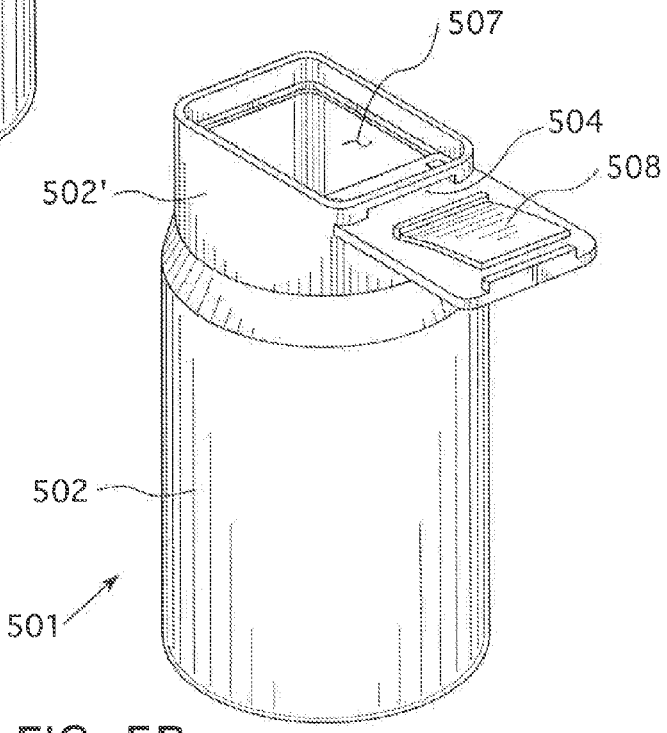

While the shapes of the medicine containers shown in FIGS. 1-4 are either cuboidal or truncations thereof, at this point it should be readily seen that the closure mechanism (i.e., blocking bar, slider, slider-groove, main and auxiliary openings and depressible tab(s) connected to the slider) may reside on the flat or curved surface of, or be joined to, any 3D shape, provided it has an inside cavity, with only minor, if any, adaptation. One example of this is the medicine container 501 with a lower cylindrical portion 502' and an upper portion 502' of cuboidal form shown in FIGS. 5A and 5B with its cylinder-like shape that makes it suitable for use in pharmacy industry automated filling machines which are presently standardized for cylindrical pharmacy bottles, but, as noted above, has its upper portion is of cuboidal form or the like with parts 504, 507, 508, 509 similar to e.g. 204, 207, 208, 209 of FIGS. 2A-2D.

Still, cuboidal shapes are generally preferred, not only because this general shape contributes to the medicine container's high degree of comfort and other ergonomic advantages but also for additional reasons which have to do with their packing efficiency. For instance, cuboids, i.e. rectangular parallelepipeds, as well as cubes, can achieve 100% ordered packing density when order packed, filled with medicine or unfilled, in mailing and shipping boxes when the dimensions of the boxes are integer multiples of the dimensions of the cuboid or cube. For comparison purposes, cylindrical objects such as popular pharmacy bottles can only achieve a maximum ordered packing density of 92%. Thus, cuboid and cube shaped medicine containers and the like are generally preferred for minimizing mailing and shipping costs. Additionally, because these shapes order pack so efficiently, they can achieve high densities on retail and warehouse shelves and in various cabinets in consumers' homes, especially in medicine cabinets.

Further, according to recent advances in mathematics modeling, cuboid and spheroellipsoid objects of certain optimal aspect ratios are found to have among the highest random packing densities of common 3D shaped objects and so in random packing situations, medicine containers having these general shapes, and certain truncations thereof, would generally be preferred for minimizing shipping costs. While random packing efficiency is not as high as ordered packing efficiency, there is usually a higher cost to order pack objects in shipping boxes as opposed to random pack the same objects and this difference could make random packing a cheaper option for transportation. For additional information on ordered and random packing density see:

a. Zhao J, Li S X, Zou R P, Yu A B. Dense random packings of spherocylinders, Soft Matter, 2012, 8(4): 1003-1009;
b. G W Delaney and P W Cleary. The packing properties of superellipsoids. EPL, 89 (2010) 34002;
c. Li S X, et al Maximum packing densities of basic 3D objects. Chinese Science Bulletin 2010, 55, 114-119;
d. Williams, S. R., et al Random Packing of spheres and spherocylinders simulated by mechanical contraction. Physical Review E 67, 051301 (2003).

Additionally, many of the medicine containers contemplated by this invention can optionally be adapted to nest (partly interpenetrate) and this is another means for improving packing density for the purposes of lowering mailing and shipping costs and warehousing costs. A variety of nesting adaptations can be contemplated in those cases where the slider and connected depressible tabs is attached to the rest of the medicine container and in the case when it is detached. When the slider is detached from the rest of the of the medicine container then it may be shipped independently from the rest of the medicine container or in the same shipping box.

Also, the containers need not be rigid. For example, a rigid or semi-rigid closure mechanism (i.e., blocking bar, slider, slider-groove, main and auxiliary openings and depressible tab(s) connected to the slider) may be adapted to interface with a supple or elastic sac or pouch (like the rigid and supple portions of a change purse in some respects). One example interface would be a rigid or semi-rigid circular or polygonal profiled tubular element extension of the closure mechanism leading into the mouth of sac or pouch, and joined, sealed or bonded by any suitable adhesive, optical, ultrasonic, mechanical (e.g., sewing, stapling, etc.) or thermal means for example. Medicine containers of this invention having non-rigid containers can be very inexpensive to ship and warehouse when made to be compressed and can have the ability to fit in irregularly shaped spaces, such as pants' pockets for example.

The medicine container possesses both physical and intellectual challenges for children making it difficult for them to gain access to the contents and the results of a study using candy demonstrating this are given in Table 2.

TABLE 2 a. Total Children Tested: 20
b. Ages:
40-44 months: 5 (25%)
45-48 months: 9 (45%)
49-51 months: 6 (30%)

| Container | Children to open container before demonstration ($1^{st}$ 5 minutes) | Total children to open container after demonstration ($2^{nd}$ 5 minutes) | Percent of children who COULD NOT open container |
|---|---|---|---|
| Standard Container | 0 | 3 | 85% |
| Target Container | 3 | 5 | 60% |
| Present Invention | 0 | 3 | 85% |

Figure 6A:
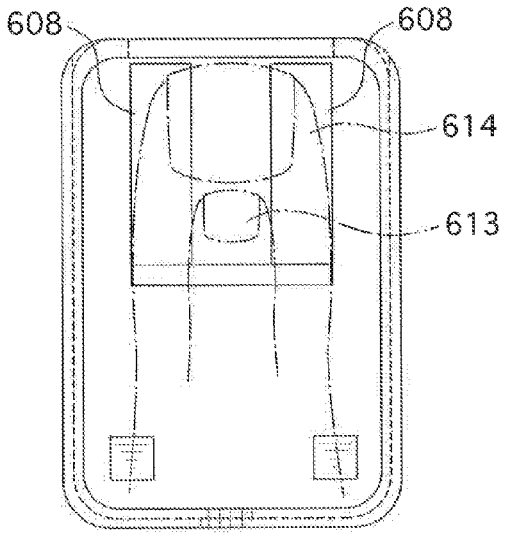
FIGS. 6A-6C show an embodiment of safe container having two independent depressible tabs, FIGS. 6A and 6C showing the same embodiment with superimposed images of an adult's and child's (about five years old or under) digit, the term digit referring to any four fingers or a thumb, but in other embodiments calling for a finger a thumb is excluded)
Figure 6C:
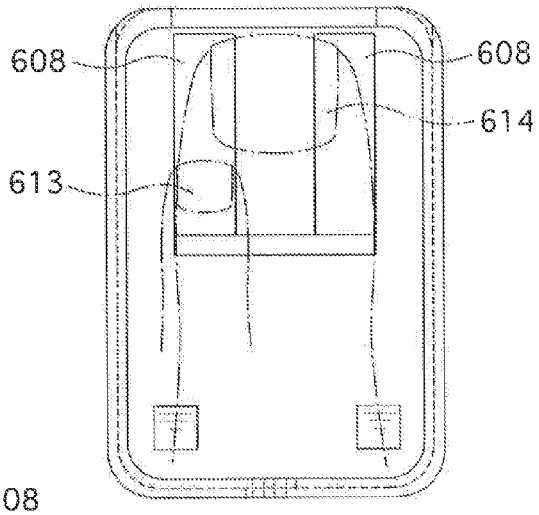
Figure 6B:
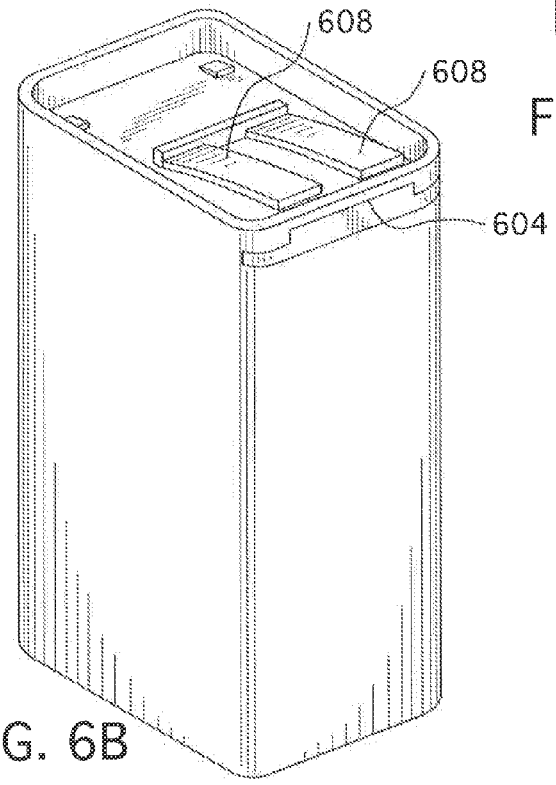
Figure 6D:
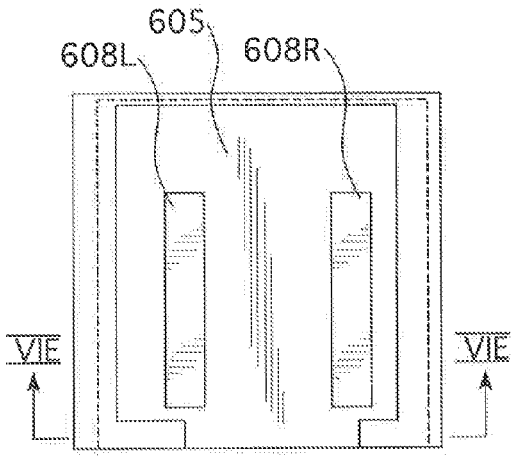
FIGS. 6D-6F show another embodiment of safe container that is particularly even more challenging for children less than five years old to open, FIG. 6D showing a 'top view' of same embodiment and FIGS. 6E and 6F showing cross sectional views of same embodiment in different stages of a closed/locked state.
Figure 6E:
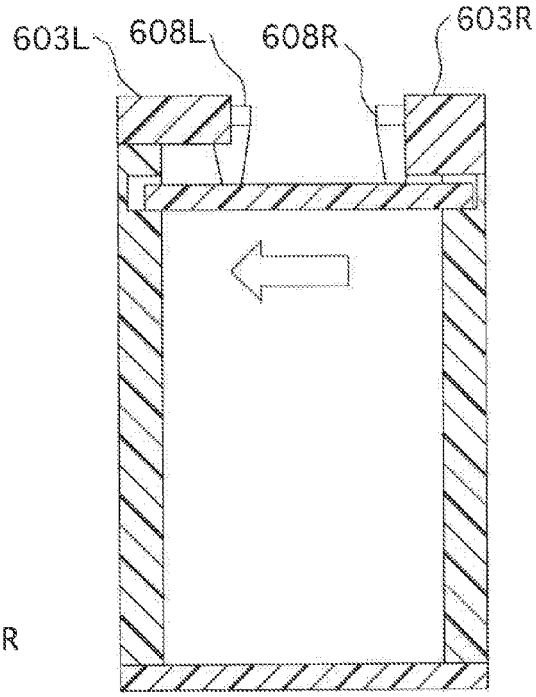
Figure 6F:
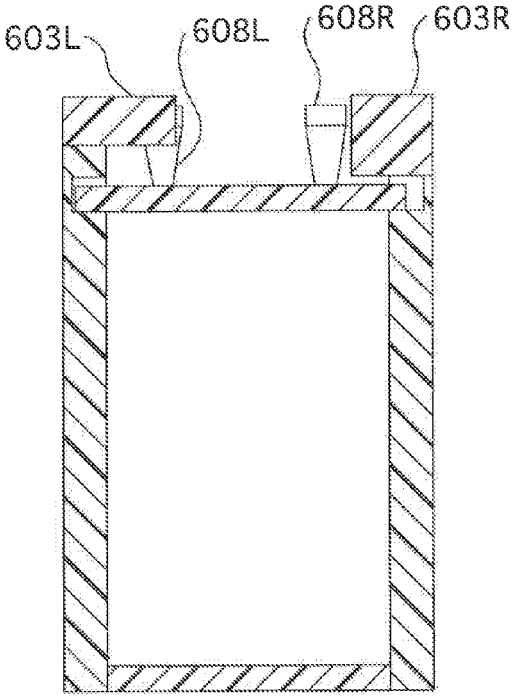

While the various studies mentioned above employed a medicine container with one depressible tab, it has also been found that having two independent depressible tabs (FIGS. 6A, 6B, 6C, 608) causes no undue burden for adults but makes for additional challenge for children, particularly with increasing distance of separation between the tabs. A reason for this is because it is physically challenging for a young (about five years old or less) child's digit 613 to span separated tabs and easy for an adult's digit 614 to span the same. Another two independent depressible tab design is shown in FIGS. 6D, 6E and 6F. Here, for the purpose of making the medicine container be an even greater challenge to children, especially those younger than about five years old, the auxiliary opening 604 and opening mechanism are intentionally made more complex and more complex appearing. As shown in FIG. 6E split blocking bar with left blocking segment 603L and right blocking segment 603R interact with left depressible tab 608L and right depressible tab 608R respectively and compression of both tabs will not open the container. However, sufficient room exists in the groove where the slider and connected depressible tabs may be moved a certain degree in the direction of the width of the container as shown by the arrow in FIG. 6E. By performing the motion in the direction of the arrow, the user arrives at the state shown in FIG. 6F. In this state the container may be opened by depressing left depressible tab 608L. Additionally, when appropriately sized, the gap between the left and right blocking segments permits adult users to extend their finger or nail over the back wall of the container and provides for easier and more convenient opening ability. It desired, the auxiliary opening and gap between the left and right blocking segments, while complex, can be covered by adapting the end of the slider to elevate upward in a manner similar to the way auxiliary opening cover 140 shown in FIG. 1A is formed.

Figure 7A:
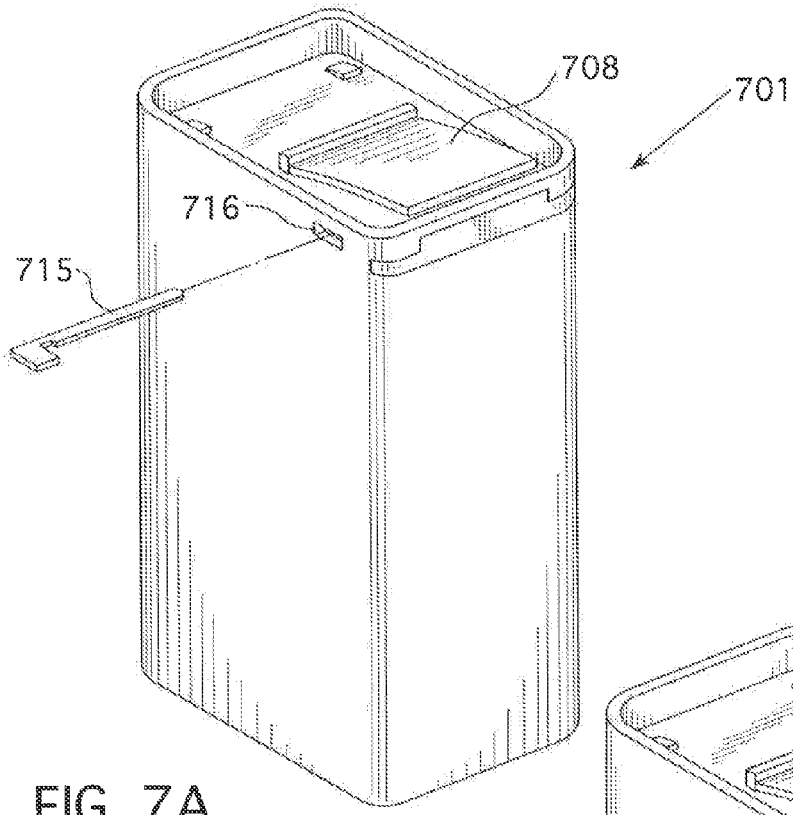
FIGS. 7A-7D show an embodiment of safe container with one embodiment of locking key disengaged (7A) engaged (7B) and an attachment variation (7C) and a variation another embodiment of locking key in a tamper resistant configuration (7D).
Figure 7B:
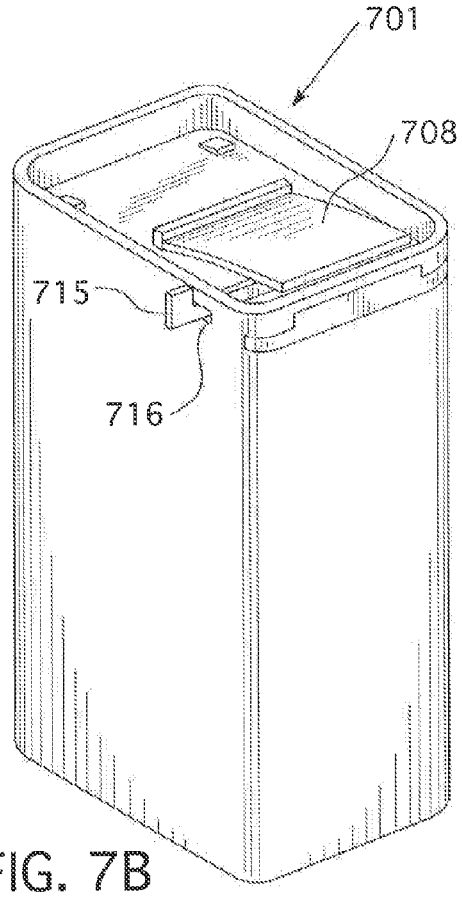

Referring to FIGS. 7A & 7B, medicine container 701 may optionally have one or more insertable locking elements 715 each of which adds to the intellectual and physical challenge for children, providing even greater child resistance, but presents no undue burden for adults. A locking element interferes with the ability to fully lower at least one depressible tab 708 to clear auxiliary opening by preventing the depressible tab 708 from being engaged. This is accomplished by having an insertion hole 716 at one or both sides of the container generally parallel to the elevation of the depressible tab. When the locking element is inserted into the insertion hole(s), it will extend generally perpendicularly underneath the depressible tab. This prevents the depressible tab from being able to push down, thus preventing anyone from opening the medicine container without first removing the insertable locking element. Moreover, as shown in FIGS. 7A and 7B the insertable locking element and insertion hole may be shaped and sized with a notch to require a 90° turn of locking element, like a lock and key, in order to provide an even greater challenge to children. These various features can dramatically decrease the number of children harmed by accidental overdoses. It is important to note, that the insertable locking element is an optional feature that does not have to be used for every medicine container because even without the insertable locking element, the medicine container is still highly child resistant.

Figure 7C:
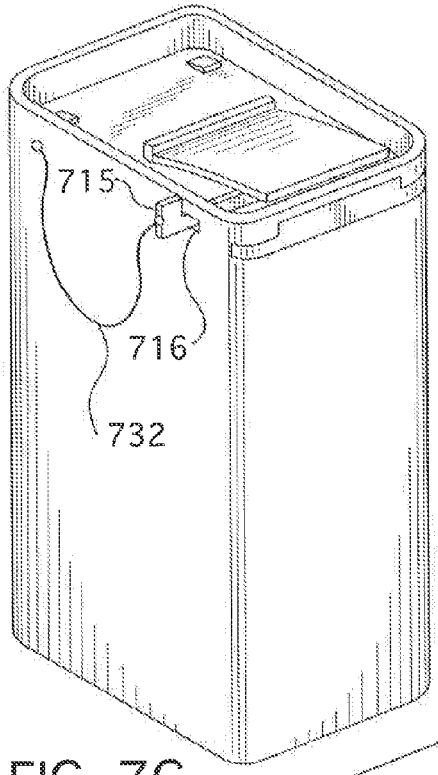
Figure 7D:
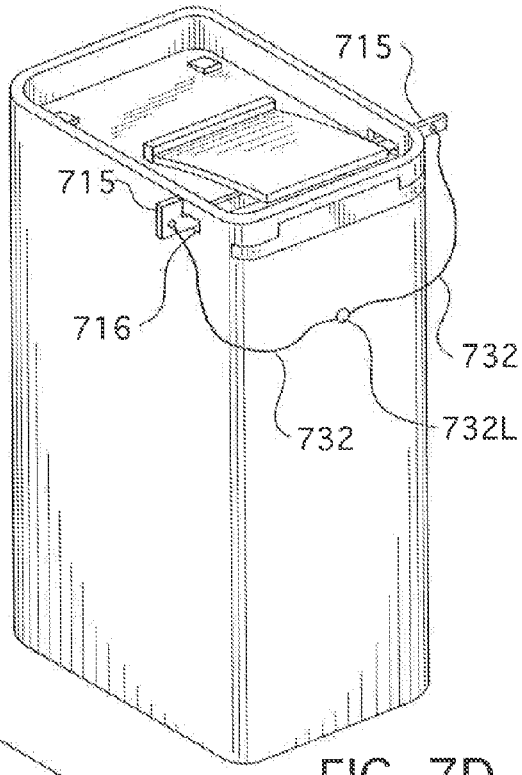

Optionally at least one end of locking element may be tethered to the medicine container so that it is not misplaced. For example, the manufacturer or pharmacy may include a tethering means 732 between one end of the locking element and the container as shown in FIG. 7C. Also, for example, each end of locking element may be connected to the container at a common connection point 732L as shown in FIG. 7D or at separate connections points. It should now be seen that a tamper resistance feature can be obtained by the strategic selection of the length of the tethering means and the placement of the connection point(s) where tethering means must be cut, unsnapped, unlocked, or otherwise unfastened in order to open the medicine container. Thus, the manufacturer or pharmacy may enable this feature after filling the medicine container and receipt by the consumer with disconnected tethering means would signal evidence of tampering during transit or while on a retail shelf. Also for example, by placing an eyelet at each end of locking element then a variety of common fasteners may be used to secure the contents of the medicine container and signal any tampering. One common fastener that can be used for this purpose is a cable tie.

The medicine container may optionally incorporate wrap or tape strategically placed over openings to indicate tampering, to provide barrier to certain gases or liquids, or for both purposes. Preferred barrier materials include PVDC copolymer film and axially-oriented PET, particularly when these films are multilayered with other polymers or metals. For example, referring to FIG. 8, a conformal dual purpose wrap 817 extending below medicine container openings, may be bonded to the medicine container using any joining technology that is suitable for the various materials involved such as, for example, adhesive, thermal bonding, and solvent, ultrasonic or optical welding at strategic locations such as around hemline 818 and may further include an optional pull tab 819.

Figure 9A:
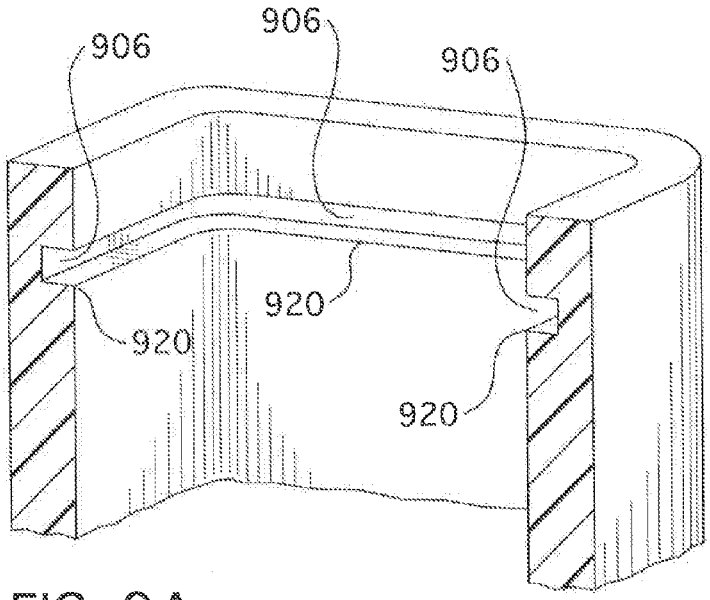
FIGS. 9A and 9B show sectional views of various embodiments of safe containers each with a different form of slider-groove.
Figure 9B:
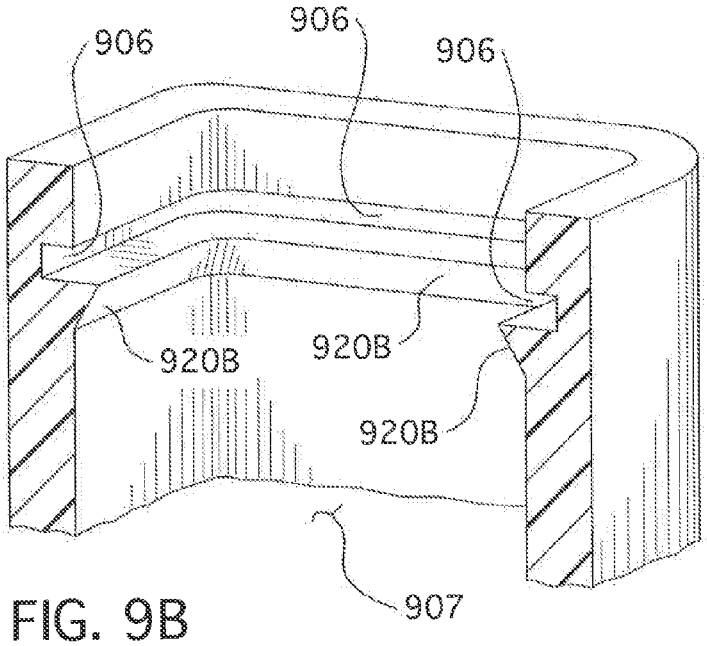

The areal dimensions and shape of the main opening need not match the dimensions or shape of the slider. FIGS. 9A and 9B show a cut-away portion of a container with an interior volume 907 and a slider-groove 906 with lower or bottom ledges 920 element. One preferred and general way to modify the size and shape of the container's opening is to extend the bottom-ledges 920 of the slider-groove 906 as shown in FIGS. 9A (920, not extended) and 9B (920B, extended). One reason for extending the bottom-ledges in such a manner is to provide for better gas and liquid sealing at the interface between the slider and the container opening. In general, the greater the surface area of contact between materials at this interface, the greater the seal. Another reason for extending the ledges is to reduce or modify the size or shape of the main opening. Optionally, the bottom-ledges may taper by various degrees to the interior wall of the container as shown in FIG. 9B in order to either optimize or decrease resistance to the flow of medicine through the main opening. Optionally, a relatively soft or compressible gasket, either inserted into slider-groove or inserted around the slider may be employed to improve the gas and liquid seal provided said gasket doesn't substantially interfere with the motion of the slider in the slider-groove. Preferably, any gasket element employed is molded to have a precise noninterfering shape.

Figure 8:
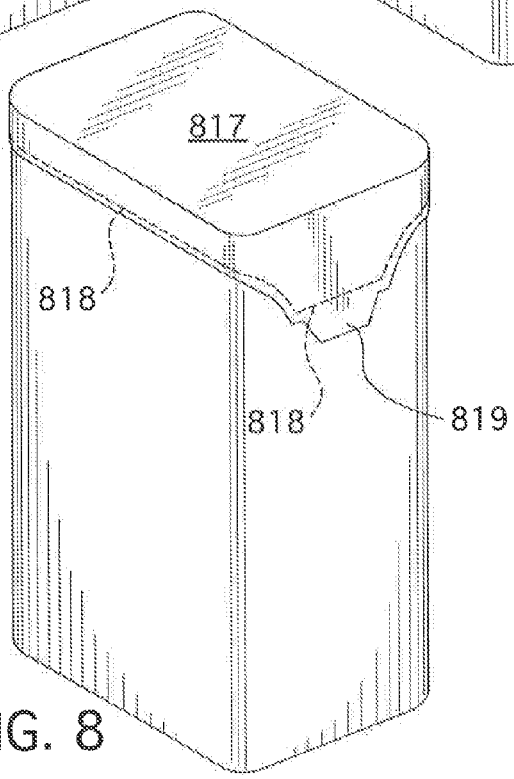
FIG. 8 shows an embodiment of safe container with a conformal wrap covering openings.
Figure 10A:
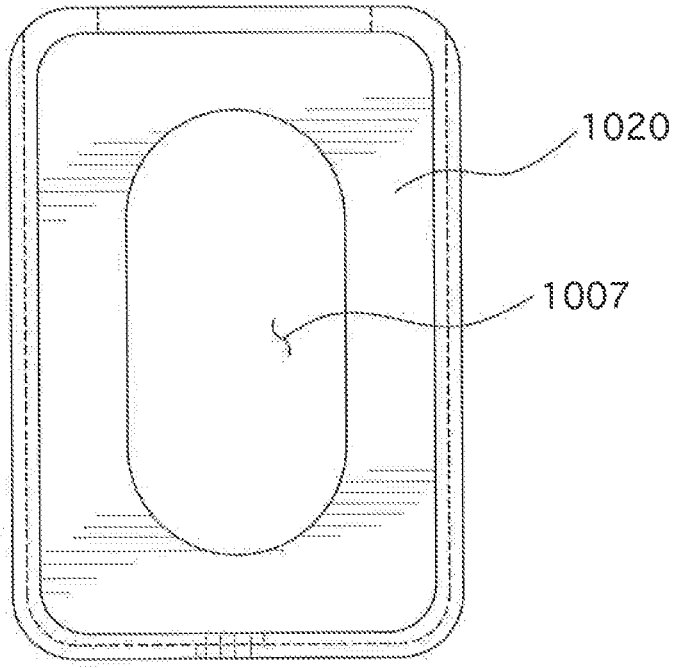
FIGS. 10A and 10B shows the main opening portion of an embodiment of a cuboidal safe container where the container opening is uncovered (10A) and where the container opening is covered (10B) with film.
Figure 10B:
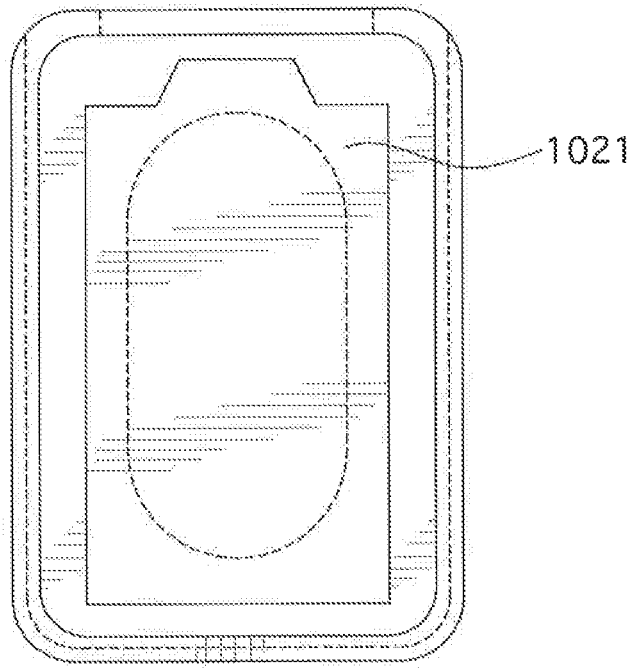

Shown in FIG. 10 is an embodiment where bottom-ledges 1020 is extended to provide an oval shaped container opening 1007, covered here in this embodiment with a ledge film 1021 that provides either tamper resistance function, gas or liquid barrier function, or both. The ledge film may be joined to the extended bottom ledge using similar means as wrap (FIG. 8, 817) and optionally include a pull tab similar to (FIG. 8, 819).

Furthermore, bottom-ledges may be extended in various ways to give multiple main openings of same or different shapes and sizes. For example, the embodiment shown in FIGS. 11A-11C show two main openings 1107 in a bottom ledge indicated 1122 in FIG. 11A to be covered by sliding closures (sliders) (FIG. 11) with depressible tabs 1108 (FIGS. 11D, 11E-1, 11E-2 and 11E-3), in FIGS. 11A-11C to be covered by sliding closure (sliders) 1105 (FIG. 11) with depressible tabs 1108 (FIGS. 11D, 11E-1, 11E-2 and 11E-3) each independently leading to two separate compartments with auxiliary openings 1140, as in FIG. 11D) of a two compartment container 1102A formed by extending the bottom-ledges of two compartment container 1102B shown in FIG. 11B. Similarly four compartment container 1102C as shown in FIG. 11C may be formed by extending the bottom-ledges of a four compartment container. Another two compartment container 1102D with parts 1102D-1 and 1102D-2 obtained by stacking is shown in FIG. 11D with an interface at 1142. A four compartment container 1102E as shown in FIG. 11E is obtained by further dividing a stacked container with dividing walls 1143 and employing shared sliders 1144 and four auxiliary openings. These embodiments are highly convenient for consumers who take multiple different kinds or doses of medicines. The multiple compartments of FIGS. 1A-1C may have inner fixed layers 1120 similar to inner layer 1020 of FIG. 10A.

Figure 12:
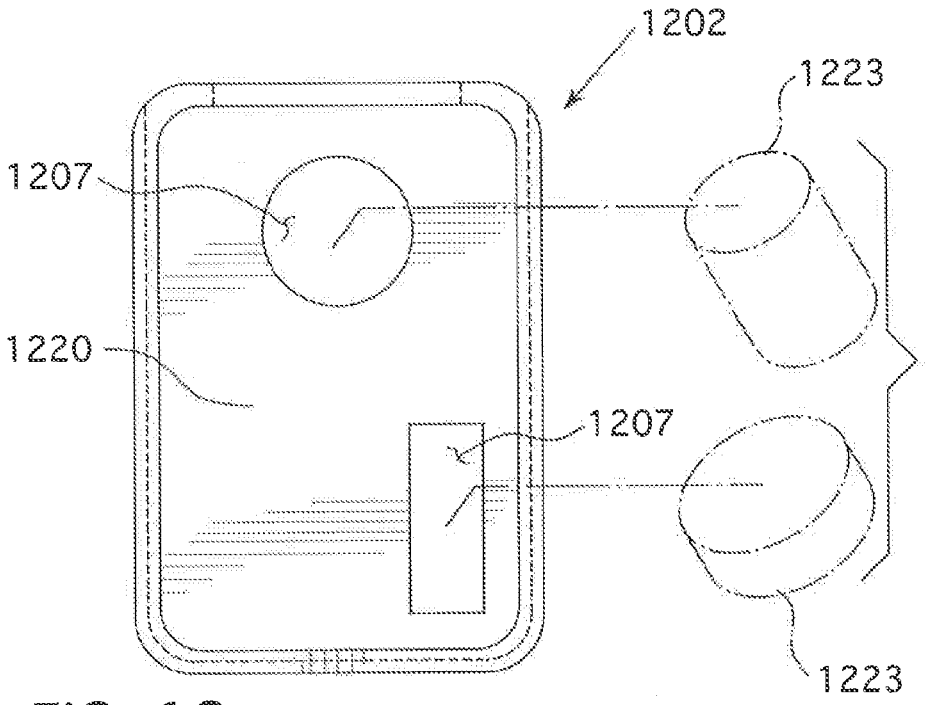
FIG. 12 shows the main opening portion of an embodiment of a cuboidal safe container showing two different shape container openings each capable of selectively passing a correspondingly shaped solid article (e.g. a pill) medicine.

Also, for example, FIG. 12 shows an embodiment where extended bottom ledges 1220 provides two container main openings 1207 each of different shape leading to single compartment container 1202. The medicine container of this embodiment can contain and classify multiple different kinds or doses of medicines 1223 by strategically pairing the shapes and sizes of medicines with corresponding container main openings. Moreover, this feature in combination with the consumer's ability to cover or uncover container main opening determined by the degree one translates the slider along slider-groove gives consumers in certain cases a highly advantageous opportunity to selectively dispense multiple drugs contained in one container.

Figure 13:
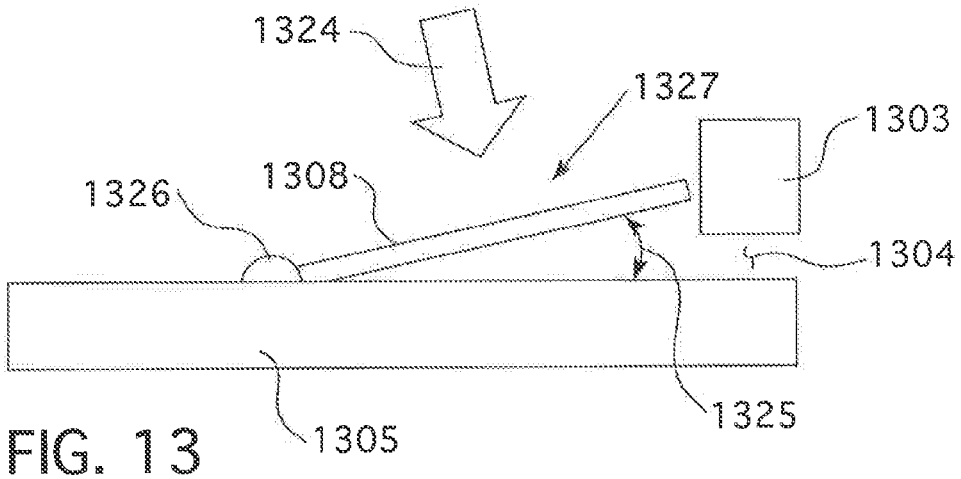
FIG. 13 illustrates the force and some of the dependent factors associated with this force required to depress a depressible tab that is set normally taller than slider opening.

Depressible Tab, Ability to Transmit Force:

The depressible tabs shown so far (108, 308, 608) have a cantilever style and being designed to be normally taller than slider-opening they have spring behavior. Referring to FIG. 13, the force 1324 required to depress this particular style of depressible tab a distance downward sufficient to avoid blocking bar 1303 and enable slider 1305 and connected depressible tab 1308 to clear auxiliary opening 1304 can be varied to achieve optimal human factor and ergonomic (HF&E) performance using well known theories and methods of chemistry, materials science, mechanical engineering and physics. In general, it depends on factors including material stiffness (elastic and flexural moduli) and dimensions, the angle 1325 made at the junction 1326 between the depressible tab and slider 1305 and the general/locked/closed position 1327 along depressible tab where the downward force is applied.

Figure 14A:
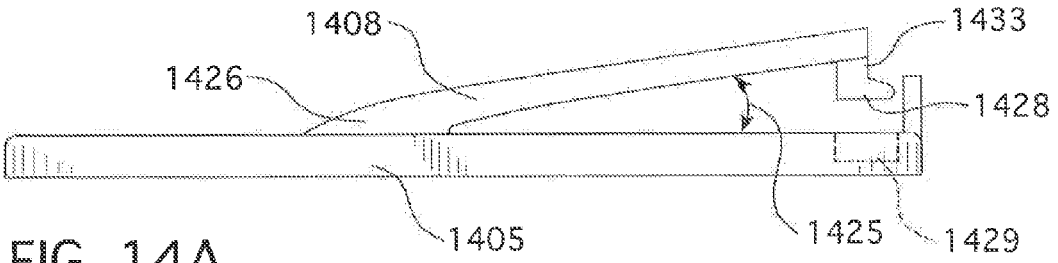
FIGS. 14A-14C show an embodiment of a cantilever style depressible tab on the surface of the slider (14A) for a safe container (14B and 14C) where structures on the slider and the blocking bar create an interference fit that transmits a sealing force between the slider and the container or bottom-ledges around the main opening.
Figure 14B:
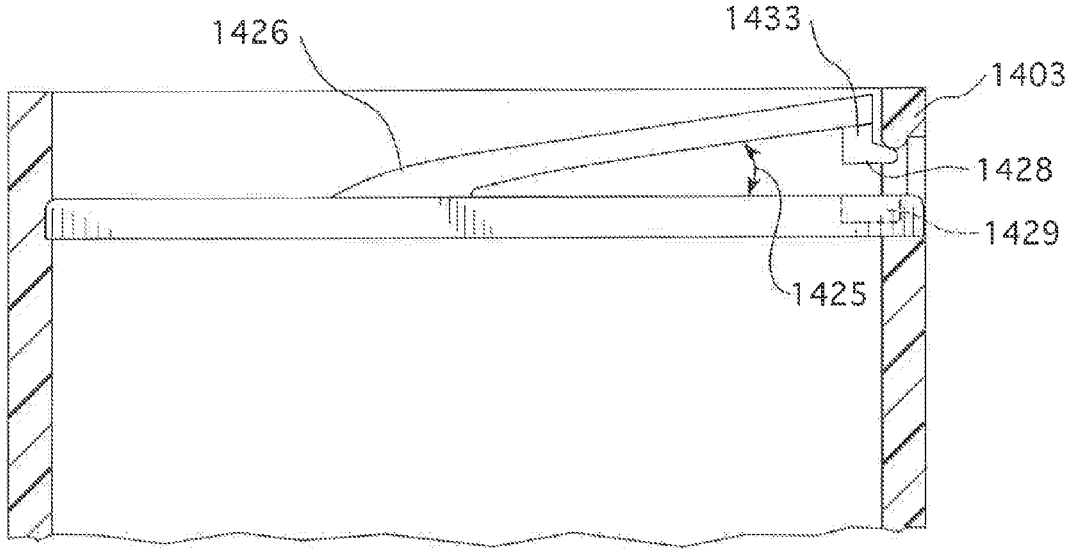
Figure 14C:
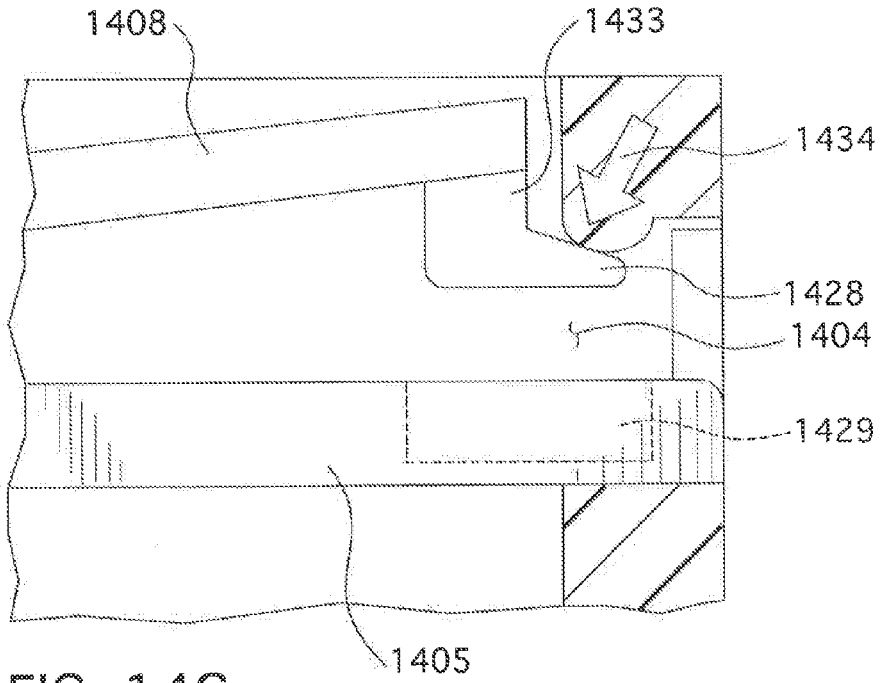

Positive Seal Mechanism:

While there are some uses of the medicine container that may not require a good seal (liquid or gas) between the bottom of the slider and the bottom-ledges of the slider-groove, and if so then it is not necessary for the dimensions of the slider and slider-groove be precisely matched so that they mate together to form a tight fit, there are other uses that do require a good seal. One way to effect a good seal is to match polish the dimensions precisely to make a tight fit. Another way is to take advantage of the spring behavior of the cantilever style depressible tabs of this invention and the geometry of the depressible tabs and the slider to create a positive sealing force between the bottom of the slider and the bottom-ledges of the slider-groove, or really any portion of the container that the bottom of the slider contacts. One way to do this is shown in FIGS. 14A-C. As shown in FIGS. 14A-C, depressible tab 1408 takes the form of a cantilever with a base attached to the slider 1405. This base attachment point is the junction 1426. The end of the depressible tab has a vertical leg 1433 and a lip 1428 perpendicular to it. The lip makes direct contact with the shaped blocking bar 1403. This contact is an interference fit between the two parts. While the slider is in the closed/locked position this fit produces a force 1434 perpendicular to the surface of the lip. This resultant force is translated along the depressible tab. For a tab surface that is at an angle (not horizontal) this force translates through the depressible tab in a downward vertical force and a lateral force in the backwards direction. The force translates into the junction 1426. The force is translated through the junction to the slider. The vertical component of the force brings into contact the inner/bottom surface of the slider with the surfaces around the perimeter of the container that it contacts such as the bottom-ledges of the slider-groove. As shown in FIGS. 14A-C a pocket 1429 depression in slider can exist to accept a portion of leg 1433 and lip 1428. This way, when the consumer compresses the depressible tab, the slider and connected depressible tab may make their way through auxiliary opening 1404. This constant contact and the force between the slider and the container can be made to vary by adjusting the geometry, dimensions and material properties of the various components to produce a positive seal appropriate for the contents of the container and the environmental conditions that the container is exposed. For design considerations, the location at which the base of depressible tab meets the slider may create a tight angle 1425. If such an angle exists, in some cases the base may be rounded with an appropriate radius in order to mitigate crack initiation from repeated usage of the depressible tab.

Figure 15A:
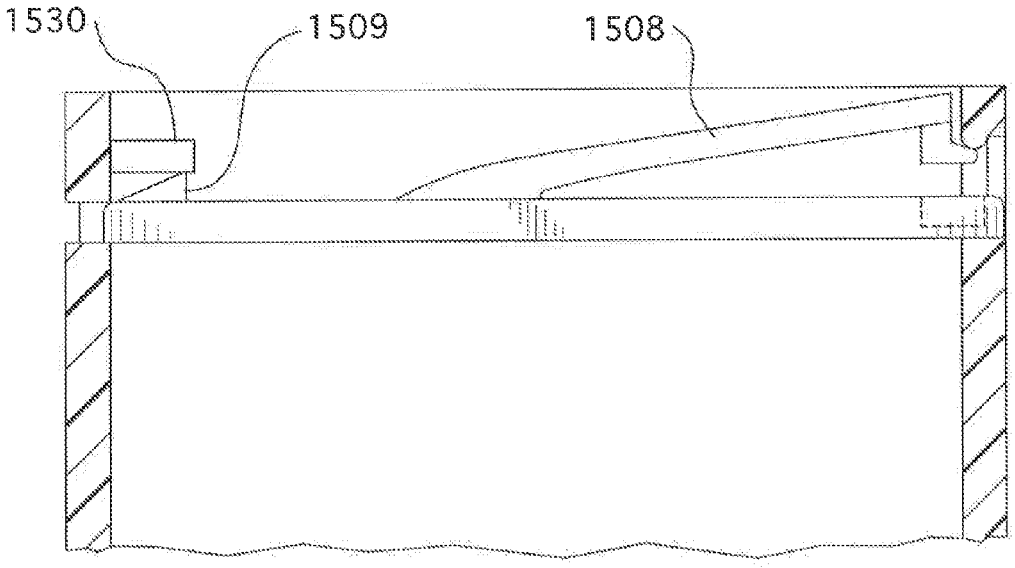
FIGS. 15A-15C show an alternative means of promoting sealing using a compressive interaction between retaining-buttons or projections on top surface of slider and protrusions on another part of safe container.
Figure 15B:
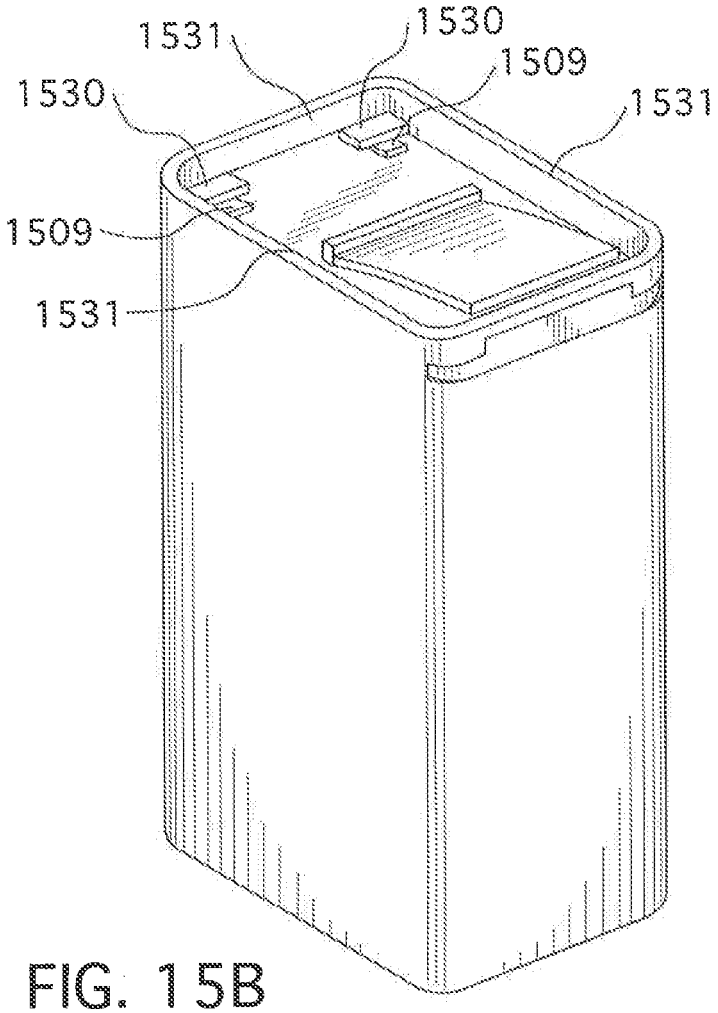
Figure 15C:
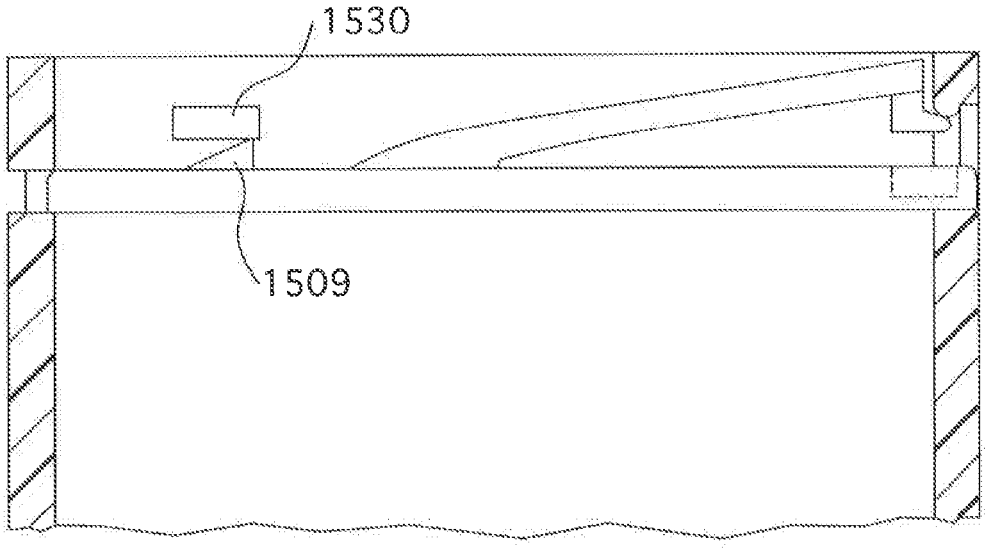

Another way to effect a good seal is shown in FIGS. 15A and 15B. Here one or more strategically placed protrusions 1530 projecting from an inner wall 1531 of the container each independently create an interference fit with a corresponding retaining projection 1509 on the top surface of the slider causing a positive sealing force between the bottom of the slider and the bottom-ledges of the slider-groove. The slider has the usual depressible tab 1508.

Figure 16:
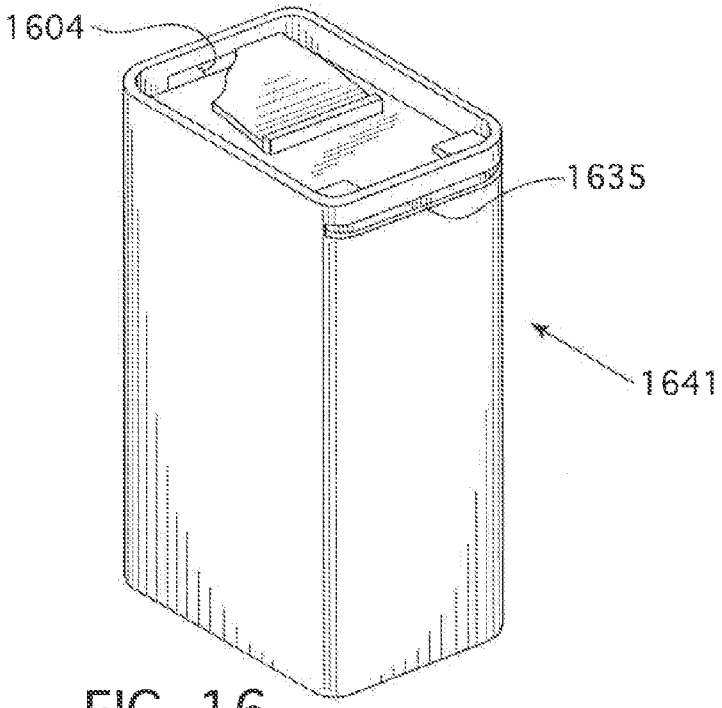
FIG. 16 shows an embodiment of the safe container in a closed/locked state having an auxiliary cleaning opening that facilitates discharge of debris that might enter slider-groove.

In some cases debris, such as powder from broken medicine tablets for example, may collect in the slider-grooves and bottom-ledges of some of the medicine container 1641 embodiments of this invention. Shown in FIG. 16 is an embodiment of a medicine container having an auxiliary cleaning opening 1635 located on a face of the container opposite the auxiliary opening 1604. Here, the slider pushes any debris that might collect in the slider-grooves or bottom ledges out the auxiliary cleaning opening when the slider is retracted and placed in the closed/locked state where the range of the slider's travel through the auxiliary cleaning opening is limited so that it may not extend beyond the wall of the container. There are a variety of ways to limit this range of travel. One way is to employ one or more sufficiently tail retaining-buttons permanently on the slider and proximal to the auxiliary cleaning opening where these retaining-buttons permanently limit the range of travel. Another way is to make the height of the auxiliary cleaning opening shorter than the height of the slider, save for a small lip profile on the slider that fits snugly in the auxiliary cleaning opening. In some medicine container embodiments of this invention, particularly ones that do not have extended ledges, the auxiliary cleaning window need not extend across the width of the container and instead, a small auxiliary cleaning opening may exist at each end of the slider-grooves in the direction of slider travel. In such cases, the slider may be shaped and profiled to have a "U-like" shape where each prong of the U-shape pokes through these auxiliary cleaning openings.

Figure 17A:
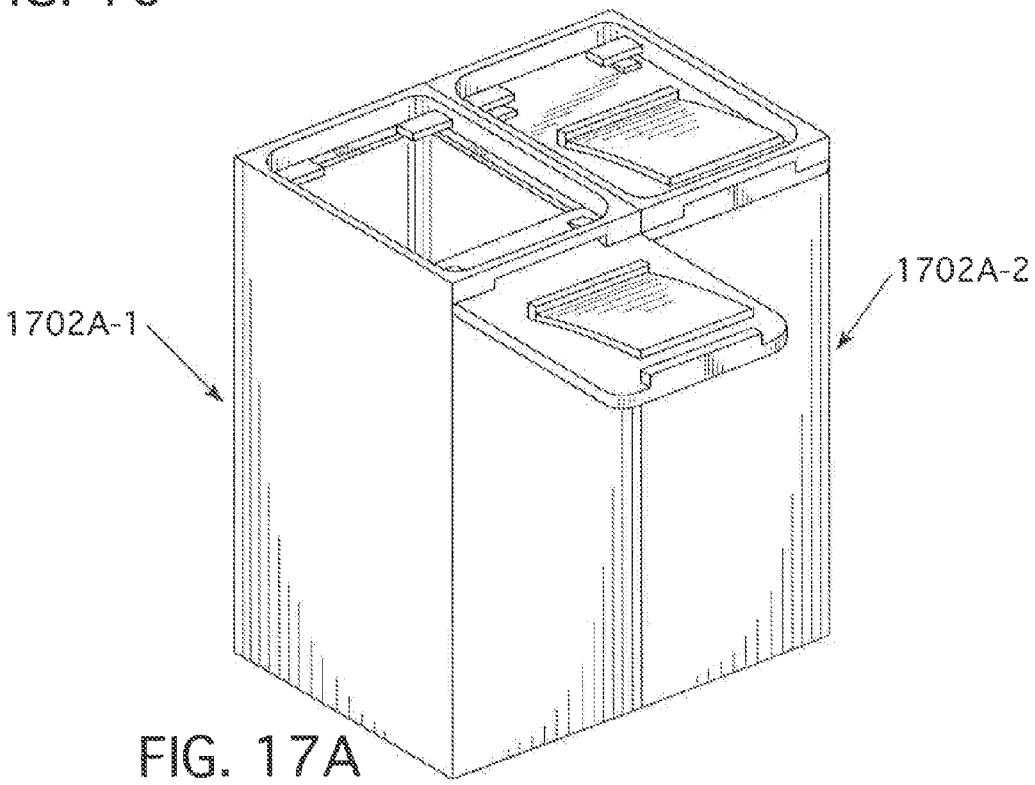
FIGS. 17A-17D show various embodiments of side by side coupling of safe containers where 17A shows an embodiment where a pair of side by side containers are fixed, 17B and 17C show an embodiment of a rotatably coupled triplet accomplished through compressive ball and socket joint
Figure 17B:
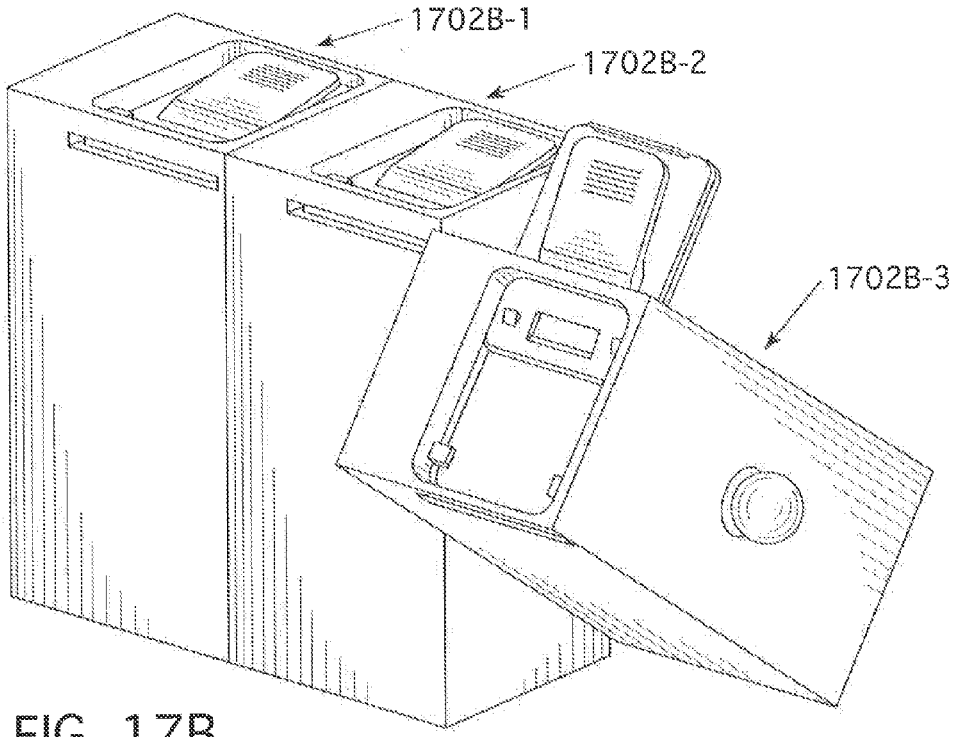
Figure 17C:
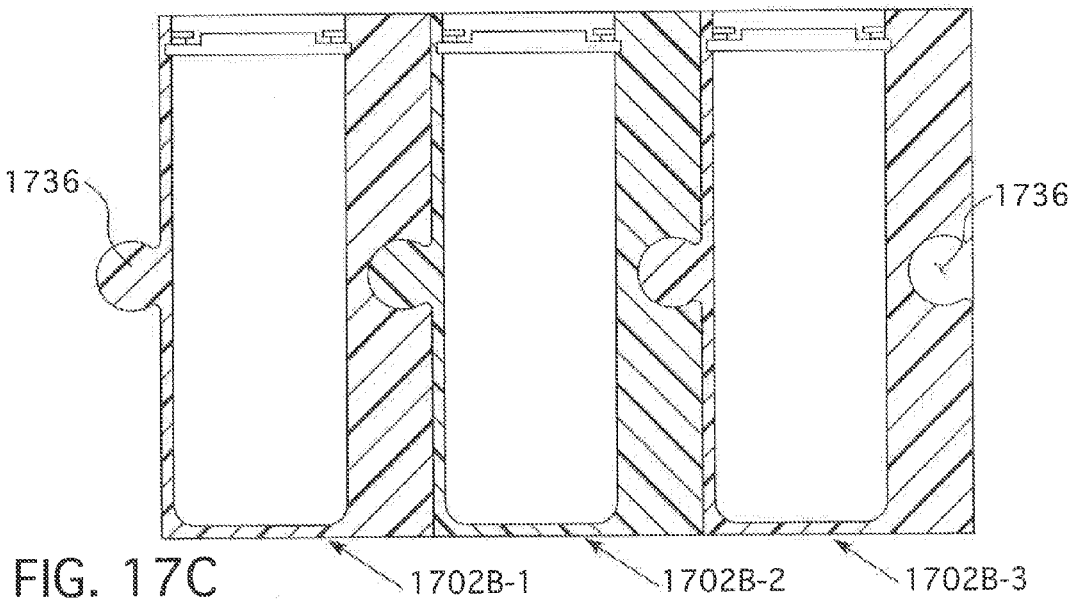
Figure 17D:
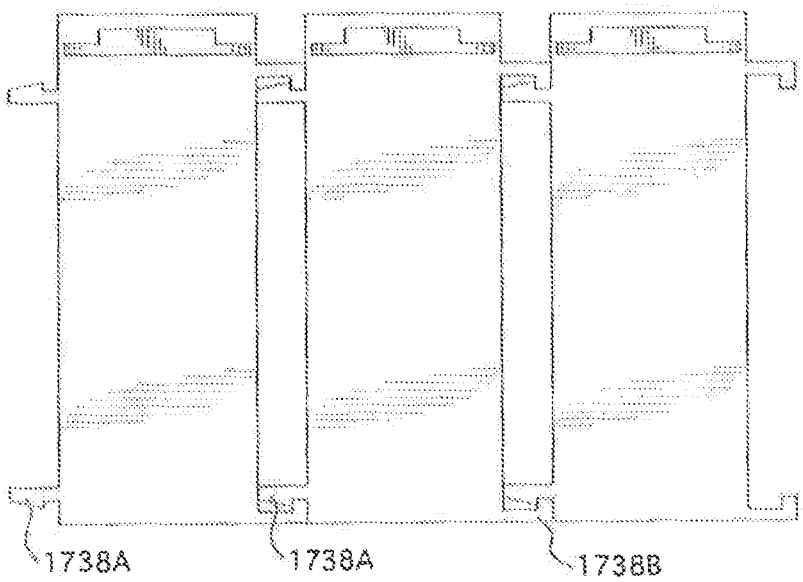

FIGS. 17A-D show that that containers can be daisy chained side-by-side as are 1702A-1, 1702B-2 and 1702B-3 or from top to bottom. Also, making them rotatably coupled is very convenient to use by hand or when rack mounted. FIG. 17C shows containers coupled together using a ball 1736 and socket 1737 mechanism, which allows them to be rotatable without having to separate containers from one another. This rotating mechanism is displayed in FIG. 17B. FIG. 17D shows interlocking rails indicated, e.g., at 1738A, 1738B which allows containers to be easily chained together as one complete unit. This is ideal for organizing and keeping together multiple medicines. There are many ways to achieve this interlocking feature with cuboidal containers. The retaining-buttons on slider may be employed for this purpose or another set of tabs or buttons independent from the retaining-buttons may be incorporated.

Most medicine containers of this invention would normally possess at least one label affixed to an exterior surface. Pertaining to this, an advantage of those medicine containers of this invention having a polyhedral or polyhedral-like shape compared to the cylindrical shape of popular pharmacy bottles is that they can have multiple faces, each face optionally carrying a label, the advantage being that each separate label may convey separate categories of information. In this manner consumers can be less intimidated and confused by complex medical jargon when presented together on same label. Optionally, a face or surface of many medicine containers of this invention, particularly those having a polyhedral or polyhedral-like shape, may have a recess in order to accommodate in a streamlined fashion multi-page instructions or information, such as a booklet or a fold-out for example, which may be permanently or semi-permanently affixed thereto. Or, alternatively, a face or surface of certain medicine containers of this invention may provide for, or incorporate a sleeve, molded as part of the medicine container or subsequently affixed, capable of accommodating a label or multi-page instructions inserted therein.

Optionally, because many consumers suffer from blurred or poor near vision, sleeve, when transparent, can be shaped in a manner that provides for, either solely or in cooperation with another transparent element of suitable shape and index covering the sleeve (like a cover slip), a magnification of images or text on labels, etc. inserted into the sleeve. Note that strategically placed rails can be a convenient way to mount other attachments or accessories such as a medicine catching attachment, as mentioned above, a funnel accessory, a mouthpiece accessory, a spoon accessory, etc.

The various wall's or parts of the medicine container enclosing the contained medicine, in particular the walls of the container and the slider, may be made opaque, to various extents, to various wavelengths of electromagnetic radiation, such as ultraviolet light and visible light for example, and to various energetic particles. One reason for doing this is to maintain the purity of contained medicines that would otherwise be affected by certain wavelengths or particles. Another reason is to shield workers and consumers from dangerous radiation or particles emitted by medicines contained in the medicine container. Means of making said walls or parts opaque include using a material for the walls or parts that is inherently opaque or made opaque by employing one or more soluble additives to said material, by employing a matrix composite wall or part material wherein at least one component provides the opacity and by providing for a multilayer composite comprising a wall or part material component as one layer and an opaque rendering component as another layer. Increasing the thickness or density of any opacity rendering component, or of an inherently opaque wall or part generally increases the level of opacity.

In a similar vein, the various walls or parts of the medicine container enclosing the contained medicine, in particular the walls of the container and the slider may, in general, be made less permeable to certain gas and liquid permeates, in particular oxygen and water vapor, by increasing the thickness as is well known in the field of transport science. In general, metals have the lowest permeabilities to permeates, followed by, at least for polymers, in general order of increasing permeability, thermosettable polymers, thermoplastics and elastomers; but there is wide overlap among these classes of polymers based on the functional groups and atoms present, the molecular weight, and as the case may be, tacticity, crystallinity, degree of crosslinking, molecular weight between crosslinks, and even based on the method and conditions employed to process (form, mold, etc.), apply or cure the polymer. The permeabilities of matrix composites and ceramic materials can vary considerably according to a number of factors as well. Fortunately the field of transport science is well established and permeability properties well known for a variety of materials towards a wide variety of permeate challenges. See, for example "Polymer Handbook, Fourth Edition", J. Brandrup, E. H. Immergut, E. A. Grulke Editors, 2003. Therefore, since medicines may have different sensitivities to different permeates, one would, generally, in the design of a medicine container consult the literature and choose an appropriate material of appropriate thickness for the walls and parts enclosing the contained medicine and also in certain cases choose an appropriate processing method and conditions to give an appropriate low permeability. Of course, one may also employ other methods as well for lowering permeability. One way, for example, is to line the inside walls of the container and the inside surface of the slider with a barrier coating such as BLOX (a Trademark of The Dow Chemical Company). Another way, for example, is to metallize the surface of a polymeric slider in contact with the main opening.

Frequently in the design of containers for foods and medicines it is necessary to consider whether or not any substances, such as plasticizers and monomers for example, might migrate from the various walls or parts enclosing the contained medicine. Similarly, it is often necessary to consider whether or not the medicine contained is compatible with the wetted materials used. If appropriate solutions cannot be found then the food or medicine may be further contained by appropriate means such as by using a foil bag for example.

Figure 18A:
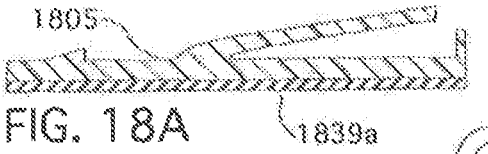
FIG. 18A shows a bilayer composite slider with a relatively harder top member and a relatively softer or compressible bottom member and 18B and 18C show this relatively softer or more compressible bottom member around the bottom perimeter.
Figure 18B:
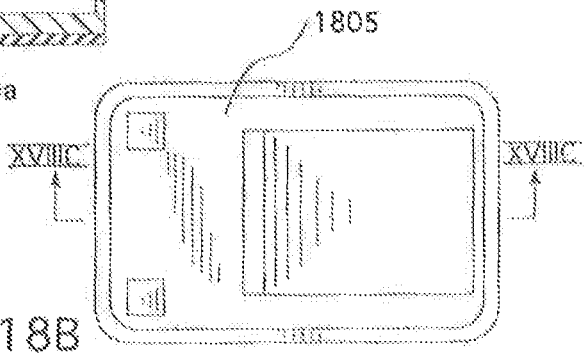
Figure 18C:
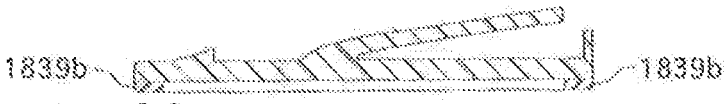

As shown in some of the embodiments above a force can be generated that provides for a better seal. Also, the greater the interfacial areal contact between slider and bottom-ledges of slider-groove, the better the seal. From a materials perspective gas and liquid sealing between two materials is often difficult to obtain when both materials are relatively hard (usually judged by durometer). Sealing is often better when a relatively softer material presses against a relatively harder material, or when both materials are relatively soft. For example, one may use a softer thermoplastic elastomer for the slider and a harder thermoplastic material, such as polypropylene, as part of the bottom ledges of the slide-groove. When regulatory guidelines limit the selection of materials to standard materials such as polypropylene then to provide for a better gas and liquid seal one can use polypropylene for both the slider and the bottom-ledges and employ a third softer gasketing material between them. Alternatively one may apply, fit, mold or otherwise include a softer element 1839*a* on the bottom of the polypropylene slider 1805 surface as shown in FIG. 18A (entire bottom surface) and FIGS. 18B and 18C or by 1839*b* (around the perimeter of the bottom surface) provided it doesn't interfere with the main opening, as part of the top of the polypropylene bottom-ledges surface.

General manufacturing methods can be used and include injection molding, particularly when thermoplastic or thermoplastic or elastomer materials are used, as well as over-molding techniques when for example metallic materials are surrounded with plastic or blow molding, particularly when glass materials are employed. Various parts or components may be manufactured separately and then assembled. In fact, in some cases in order to facilitate filling it may be desirable to separately fabricate the a portion, side or face of a medicine container and subsequently permanently join the portion, side or face to the rest of the container.

Figure 19A:
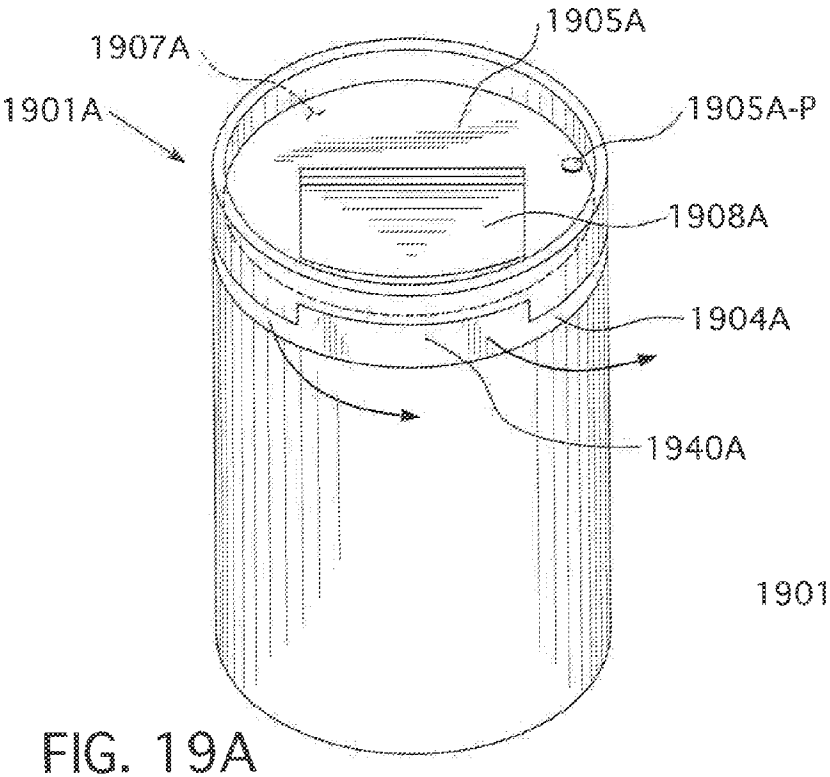
FIGS. 19A and 19B show curved sliders moving in a longitudinal or circumferential paths of a cylinder.
Figure 19B:
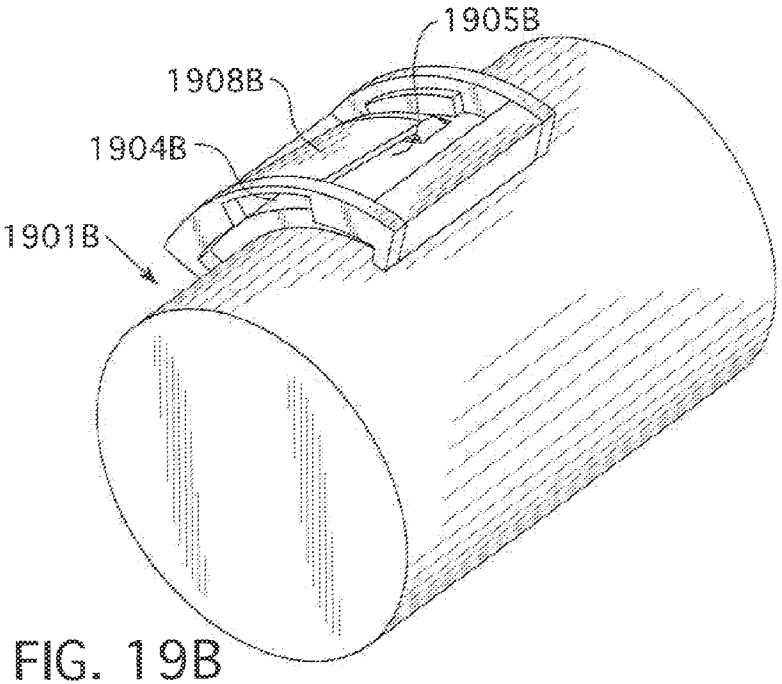

FIGS. 19A and 19B illustrate a general option for sliders to move along curved paths—as all or part of a container top (FIG. 19A) or as part of a curved container wall (FIG. 19B). In FIG. 19A the container 1901A is cylindrical and has a main opening 1907A sliding closure 1905A, with a distal end 1940A, of a cantilevered depressible tab 1908A, that is rotatable about pivot 1905A A-P (supported on a fixed container piece internally or externally) to slide through auxiliary opening 1904A. FIG. 19B shows a cylindrical container 1901B with a sliding closure 1905B, with a cantilevered (evened depressible tab 1908B with a distal end 1940B, that slides along the circular container surface (on internal tracks or grooves, not shown) to exit the container in part through auxiliary opening 1904B. As shown in the breakout of FIG. 19B, the distal end 1904E is leveled to match the containers contour when the slider is retracted.

These variant forms can also be applied to spherical, hemispherical, ellipsoidal container forms and other regularly and irregularly shaped containers with appropriate tracks, grooves or other sliding closure supports/guides. They can also apply stop buttons and/or locks as in other forms shown above and in the case of FIG. 19A or the line designating the pivot as a restrainer/lock that prevents from exit of the sliding closure but can be remarked by means not accessible to a child or other nobled user.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. A child protective hand-holdable container for solid articles, fluids, or other contents with safe closure comprising:

the container with a main fixed opening for access to the contents by pouring the contents therefrom or inserting of a finger or utensil and having at least one fixed auxiliary opening, at least one sliding closure for blocking the main opening with an inner surface relative to the container interior and an opposite outer surface, slidingly translatable through said fixed auxiliary opening in the container to clear the main opening and exit the container partially or completely and slidingly translatable back for re-blocking the main opening and further comprising:

a depressible extension of cantilever form on the closure with a proximal end, fixed on an outer surface of the closure and an unfixed free distal end, the closure itself blocking the main opening without the extension, and the depressible extension of the closure constructed and arranged so that vertically depressing the extension enables horizontal sliding closure movement through the auxiliary opening, and translation back through the auxiliary opening, the extension being free of the auxiliary opening when the sliding closure fully blocks the main opening.

2. The safe closure container of claim 1 wherein the translation motion is linear along a planar or curved path to exit or enter via the auxiliary opening.

3. The safe closure container of claim 1 wherein the translation motion is rotary, the closure pivoting about an axis parallel to it to exit or enter via the auxiliary opening.

4. The safe closure container of claim 1 constructed and arranged to produce an audible, tactile and/or visible signal upon a full coverage of the main opening by retraction of the closure using the relaxation of the cantilever distal end of the depressible extension upon such retraction from a compressed state while passing through the auxiliary closure.

5. The safe closure container of claim 1 further comprising one or more buttons on the sliding closure to prevent the sliding closure from wholly escaping the container via the auxiliary opening in normal use.

6. The safe closure container of claim 5 wherein at least two spaced buttons are provided on the closure's outer or inner surface and configured to be stopped by a container wall structure near the auxiliary opening, the buttons adjustable selectively, but not in the course of the regular main opening uncovering and covering, to clear the auxiliary opening for full removal of the closure from the container.

7. The safe closure container of claim 6 with separate multiple depressible extension tabs of the sliding closure to require operation by a single adult finger, but not operable by a single child's finger.

8. The safe closure container of claim 5 wherein the at least one or more buttons are provided on the closure's outer surface and configured to be stopped by a container wall structure near the auxiliary opening, the buttons being adjustable selectively, but not in the course of the regular main opening uncovering and covering, to clear the auxiliary opening for full removal of the closure from the container.

9. The safe closure container of claim 8 wherein said multiple depressible extension buttons of the sliding closure are constructed and arranged to require operation by a single adult finger, but not operable by a single child's finger.

10. The safe closure container of claim 1 with finger grip sections to stabilize a hand grasping the container as a base for thumb depressing and pushing or pulling of the sliding closure.

11. The safe closure container of claim 1 with tamper resistant locks.

12. The safe closure container of claim 11 wherein said one or more additional tamper resistant locks comprises a side opening of the container and a locking element insertable under the sliding closure depressible extension to prevent or limit pressing of said depressible extension and thereby prevent the sliding closure from wholly exiting via the auxiliary opening.

13. The safe closure container of claim 12 wherein a further container opening is provided to enable insertion of the locking element under the depressible extension and removal.

14. The safe closure container of claim 12 wherein said container has a secondary fixed closure which comprises a conformable wrap overlaying and bonded to a container top including the sliding closure atop the main opening and overlapping container sides sufficiently to block the auxiliary opening.

15. The safe closure container of claim 14 wherein said secondary fixed closure conformable wrap comprises a pull tab for removal of the wrap.

16. The safe closure container of claim 1 with at least one of said locks, preventing the depressible sliding extension from depressing and thereby preventing the sliding closure from exiting through auxiliary opening.

17. The safe closure container of claim 1 wherein edges of the sliding closure ride on one or more internal tracks of the container.

18. The safe closure container of claim 1 wherein edges of the sliding closure ride a groove on one or more internal grooves of the container.

19. The safe closure container of claim 18 wherein the groove has a ledge extension inward of the container for enhanced main opening sealing and/or auxiliary opening sealing.

20. The safe closure container of claim 1 comprising a secondary fixed closure inward of the sliding closure with one or more shaped openings to receive correspondingly shaped contents.

21. The safe closure container of claim 1 wherein the free distal end of the cantilever form, depressible extension is configured to hook an edge of the auxiliary opening for sealing but the auxiliary opening has an indentation for the free distal end of the cantilever extension tab to enter into to enable the sliding closure to pass through the auxiliary opening.

22. The safe closure container of claim 1 with a cuboidal form.

23. The safe closure container of claim 1 with a truncated cuboidal form.

24. The safe closure container of claim 1 with a cuboidal or truncated cuboidal form of an upper portion of the container and a cylindrical form for a lower portion of the container.

25. A multiplicity of claim 1 safe closure containers stacked vertically and/or horizontally and locked together with means for locking and unlocking and/or for tilting are relation of one stacked container relative to an adjacent one of the containers without unlocking.

26. A container for solid articles, fluids, or other contents with safe closure comprising:

the container having a main opening for access to contents opening and an auxiliary opening, at least one sliding closure for blocking and unblocking said main opening, the closure having an inner surface relative to the container interior and an opposite outer surface, the closure being slidingly translatable through the auxiliary opening in the container to clear the main opening partially or completely and slidingly translatable back to reclose the main opening, a depressible extension of cantilever form on the closure with a proximal end fixed on an outer surface of the closure and an unfixed free distal end the depressible extension of the closure constructed and arranged so that depressing the extension enables sliding closure movement through the auxiliary opening one or more buttons on the sliding closure to prevent the sliding closure from wholly escaping the container via the auxiliary opening in normal use, and two spaced buttons provided on the outer surface of the sliding closure and configured to be stopped by a container wall structure near the auxiliary opening, but adjustable selectively but not in normal usage of main opening uncovering and covering, to clear the auxiliary opening for full removal of the closure from the container.

* * * * *